US011333992B2

(12) United States Patent
Noguchi et al.

(10) Patent No.: US 11,333,992 B2
(45) Date of Patent: May 17, 2022

(54) IMAGE FORMING APPARATUS AND CARTRIDGE

(71) Applicant: CANON KABUSHIKI KAISHA, Tokyo (JP)

(72) Inventors: Bunro Noguchi, Shizuoka (JP); Hisashi Taniguchi, Shizuoka (JP); Atsushi Toda, Shizuoka (JP); Shunsuke Matsushita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/343,906

(22) Filed: Jun. 10, 2021

(65) Prior Publication Data

US 2021/0389689 A1 Dec. 16, 2021

(30) Foreign Application Priority Data

Jun. 12, 2020 (JP) ..... JP2020-102715

(51) Int. Cl.
*G03G 15/02* (2006.01)
*G03G 21/18* (2006.01)
*G03G 15/00* (2006.01)

(52) U.S. Cl.
CPC ..... *G03G 15/0225* (2013.01); *G03G 15/757* (2013.01); *G03G 21/1814* (2013.01)

(58) Field of Classification Search
CPC ..... G03G 15/0225; G03G 15/757; G03G 21/1814
See application file for complete search history.

(56) References Cited

U.S. PATENT DOCUMENTS 5,436,707 A * 7/1995 Ogane ..... G03G 15/0258 399/111
6,064,845 A * 5/2000 Suzuki ..... H01T 19/00 250/324
6,697,589 B1 * 2/2004 Dunning ..... G03G 21/1647 399/107
7,599,643 B2 * 10/2009 Takamatsu ..... G03G 15/0225 250/324
2009/0092410 A1 * 4/2009 Thayer ..... G03G 21/169 399/100
2010/0166456 A1 * 7/2010 Shimizu ..... G03G 15/0225 399/114
2011/0318034 A1 * 12/2011 Kimura ..... G03G 15/0258 399/50

FOREIGN PATENT DOCUMENTS

JP H04-123076 A 4/1992
JP 04145464 A * 5/1992
JP H06-138780 A 5/1994
(Continued)

*Primary Examiner* — Sevan A Aydin
(74) *Attorney, Agent, or Firm* — Venable LLP

(57) ABSTRACT

An image forming apparatus includes a photosensitive member, a charging member for charging the photosensitive member, a cleaning member that comes into contact with the charging member and moves relative to the charging member to clean the charging member, an opening/closing member for exposing an inside of the apparatus, and a driving mechanism that moves the charging member and the cleaning member relative to each other in association with opening/closing of the opening/closing member.

16 Claims, 27 Drawing Sheets

(56) References Cited

FOREIGN PATENT DOCUMENTS

| | | | | |
|---|---|---|---|---|
| JP | H06-194934 | A | | 7/1994 |
| JP | H08-227207 | A | | 9/1996 |
| JP | 2001-022167 | A | | 1/2001 |
| JP | 2006-243530 | A | | 9/2006 |
| JP | 2006-243531 | A | | 9/2006 |
| JP | 2006-251195 | A | | 9/2006 |
| JP | 2015041002 | A | * | 3/2015 |

* cited by examiner

IMAGE FORMING APPARATUS AND CARTRIDGE

BACKGROUND OF THE INVENTION

Field of the Invention

The present invention relates to an electrophotographic image forming apparatus.

Description of the Related Art

Conventionally, as a method of charging a photosensitive drum in an image forming apparatus using an electrophotographic technique, a corona charging method using a charging wire has been known. The corona charging method has a problem in that, when an image forming operation is repeated, a foreign material is deposited on the charging wire, thereby degrading a discharge capability and causing vertical streaks. Accordingly, there is an image forming apparatus provided with a cleaning unit that removes a foreign material deposited on a charging wire (see, e.g., Japanese Patent Application Publication No. H08-227207). According to Japanese Patent Application Publication No. H08-227207, when a cover of a housing of the image forming apparatus is opened, an operation portion for wire cleaning is exposed and, with the operation portion being moved by a user, the charging wire can be cleaned. By thus operating a charging wire cleaning member without taking out a process cartridge from a position in the image forming apparatus where the process cartridge is attached thereto, it is possible to clean the charging wire.

SUMMARY OF THE INVENTION

However, in the method described in Japanese Patent Application Publication No. H08-227207, the user first widely opens the cover of the image forming apparatus and then manually moves the cleaning member over an entire region of the charging wire to clean the charging wire, resulting in a heavy workload placed on the user.

An object of the present invention is to provide a technique which can reduce a workload placed on a user to clean a charging member.

To attain the above object, an image forming apparatus of the present invention includes: a photosensitive member;

a charging member for charging the photosensitive member;

a cleaning member that comes into contact with the charging member and moves relative to the charging member to clean the charging member; and an opening/closing member for exposing an inside of the apparatus, the image forming apparatus further comprising a driving mechanism that moves the charging member and the cleaning member relative to each other in association with opening/closing of the opening/closing member, wherein the driving mechanism moves the cleaning member relative to the charging member that is fixed.

Further features of the present invention will become apparent from the following description of exemplary embodiments with reference to the attached drawings.

DESCRIPTION OF THE EMBODIMENTS

Figure 1:
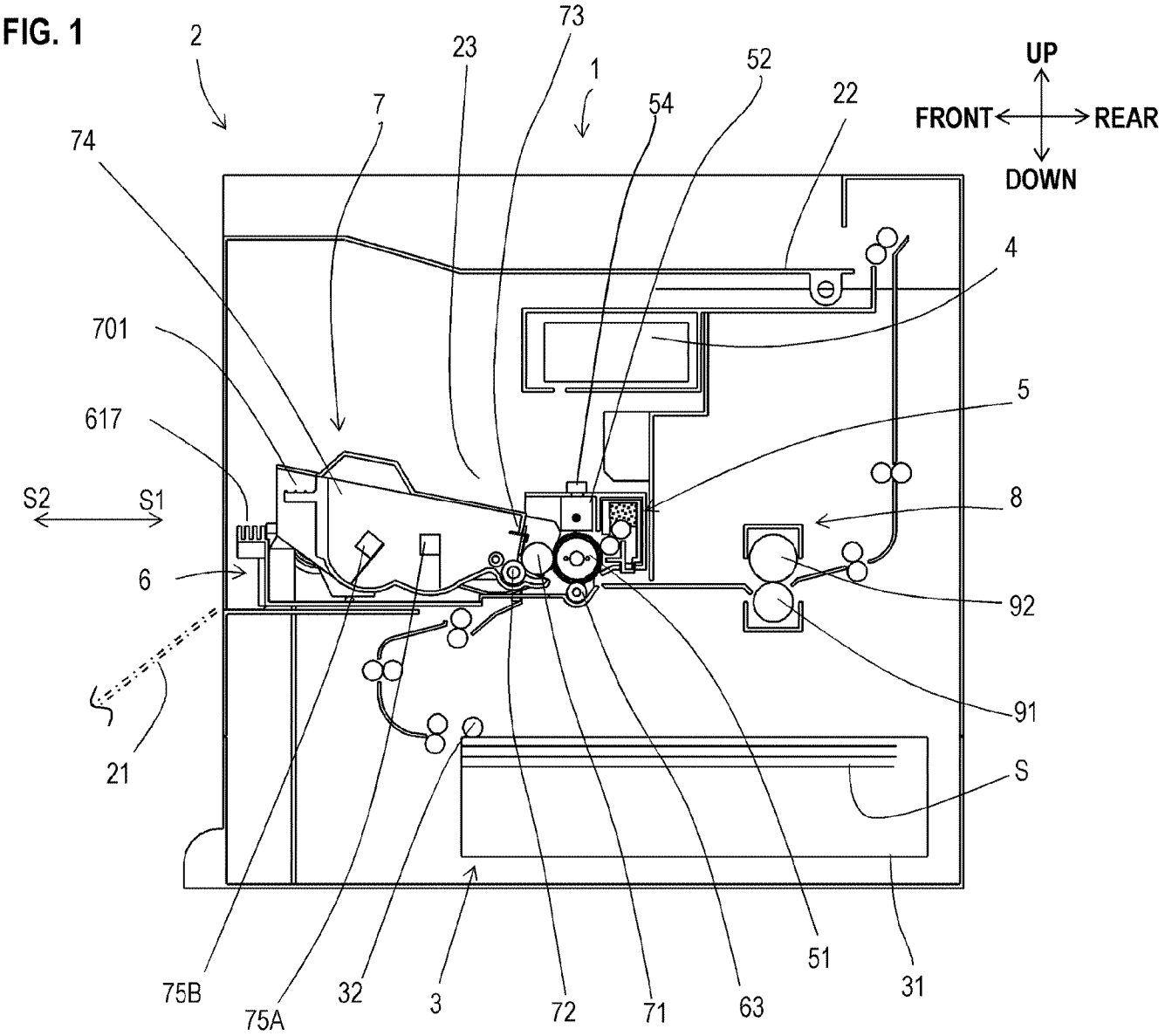
FIG. 1 is a cross-sectional view of an image forming apparatus including a process cartridge.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

The following description defines directions based on a user who uses an image forming apparatus 1. Specifically, a front surface side, a back surface side, an upper surface (top surface) side, and a lower surface (bottom surface) side of the image forming apparatus 1 are defined as "front", "rear", "up", and "down", respectively. Additionally, a left side and a right side of the image forming apparatus 1 when the image forming apparatus 1 is viewed from the front surface side thereof are defined as "left" and "right", respectively. For a process cartridge 5 also, directions are defined in the same manner as for the image forming apparatus 1 on the assumption that the process cartridge 5 assumes the same posture as assumed in a state where the process cartridge 5 is attached to the image forming apparatus 1. In each of the drawings, the individual directions are defined by respective arrows illustrated in the drawing. A front-rear direction, an up-down direction, and a left-right direction indicated by the arrows are perpendicular to each other. These directions refer to the same directions in all the drawings. The up-down direction is parallel with a vertical direction, while the left-right direction and the front-rear direction are parallel with a horizontal direction. Meanwhile, the left-right direction is parallel with each of a rotation axis direction of a photosensitive drum 51 and a rotation axis direction of a development roller 71. An integrated combination of a development unit 7 and a photosensitive member unit 6 obtained by attaching the development unit 7 to the photosensitive member unit 6 is referred to as the process cartridge 5. When attached to an apparatus main body 2, the process cartridge 5 is inserted therein in a direction (insertion direction) indicated by an arrow S1 in the drawing and detached in a direction indicated by an arrow S2 in the drawing.

Overall Configuration of Image Formation Device

FIG. 1 is a cross-sectional view of the image forming apparatus 1 having the process cartridge 5 attached thereto. The image forming apparatus 1 mainly includes a sheet feeding unit 3 for feeding a sheet S into the apparatus main body 2, an exposure device 4, the process cartridge 5 that transfers a toner image onto the sheet S, a fixation device 8 that thermally fixes the toner image transferred onto the sheet S, and a toner feeding unit 94.

The sheet feeding unit 3 is provided in a lower part of the apparatus main body 2 and mainly includes a sheet feeding tray 31 and a sheet feeding mechanism 32. The sheet S contained in the sheet feeding tray 31 is fed by the sheet feeding mechanism 32 toward the process cartridge 5 (a gap between the photosensitive drum 51 and a transfer roller 63).

The exposure device 4 is disposed in an upper part of the apparatus main body 2 and includes a laser light emitting unit not shown and a polygon mirror, a lens, a reflection mirror, and the like which are illustrated without reference numerals. In the exposure device 4, laser light based on image data which is emitted from the laser light emitting unit rapidly scans a surface of the photosensitive drum 51 to expose the surface of the photosensitive drum 51.

The process cartridge 5 is disposed below the exposure device 4. The process cartridge 5 is configured to be inserted into a containing portion 23 of the apparatus main body 2 in an insertion direction S1 through an opening formed when a door (opening/closing member) 21 provided in the apparatus main body 2 is opened (indicated by a two-dot-dash line in FIG. 1) and attached to the apparatus main body 2. When the process cartridge 5 is detached from the apparatus main body 2, the process cartridge 5 is moved in the detachment direction S2 to be taken out.

The process cartridge 5 mainly includes the photosensitive member unit 6 and the development unit 7. The photosensitive member unit 6 mainly includes the photosensitive drum 51 serving as an image bearing member (photosensitive member), a scorotron charger 52, a cleaning member 54, and a transfer roller 63. The development unit 7 is configured to be detachably attached to the photosensitive member unit 6. The development unit 7 mainly includes the development roller 71, a feeding roller 72, a layer thickness control blade 73, a toner containing portion (developer containing portion) 74 containing a toner (developer) therein, and first and second agitators 75A and 75B provided in the toner containing portion 74.

The scorotron charger 52 is disposed to be spaced apart at a predetermined distance from the photosensitive drum 51 so as not to come into contact therewith. In addition, as a charging member extending in the left-right direction, a charging wire 53 is provided. To clean the charging wire 53, the cleaning member 54 formed of sponge or the like is provided in contact with the charging wire 53. Note that the cleaning member 54 is movable along a direction (longitudinal direction) in which the charging wire 53 extends.

Figure 6:
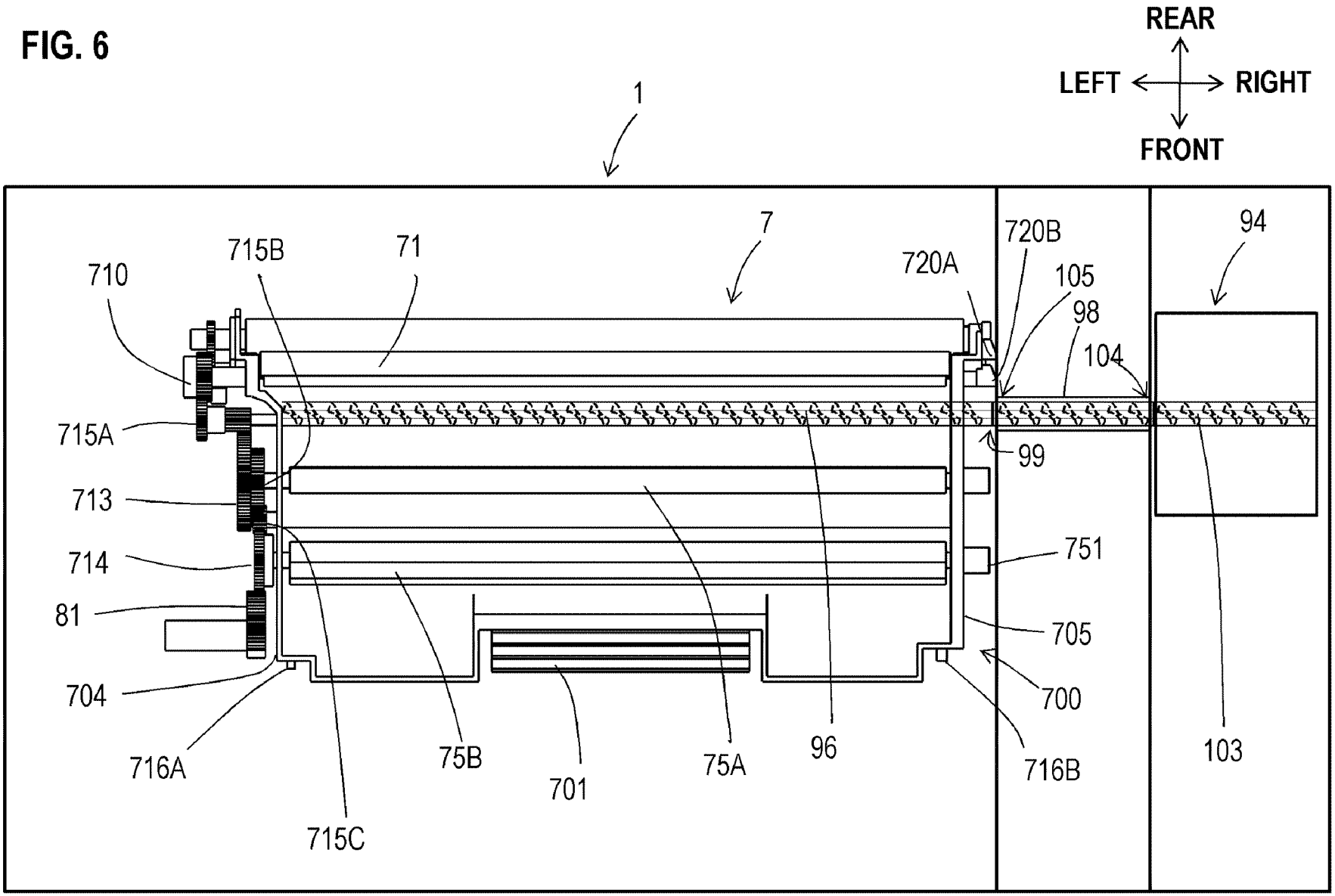
FIG. 6 is a top view of the development unit.

As illustrated in FIG. 6, the toner feeding unit 94 is located on a right side of the development unit 7. The toner feeding unit 94 (described later in detail) is capable of feeding the toner to the development unit 7 of the process cartridge 5. The toner feeding unit 94 is attached to the apparatus main body 2.

Image Formation Process

Next, a description will be given of an image formation process using the process cartridge 5. The photosensitive drum 51 is driven to rotate while an image formation process is performed. First, the surface of the photosensitive drum 51 is uniformly charged by the scorotron charger 52 and then exposed to the laser light corresponding to the image data which is emitted from the exposure device 4, resulting in formation of an electrostatic latent image corresponding to the image data on the photosensitive drum 51.

Meanwhile, the toner in the toner containing portion 74 is stirred by the second agitator 75B and the first agitator 75A, and then fed to the development roller 71 via the feeding roller 72. Subsequently, the toner fed to the development roller 71 enters a gap between the development roller 71 and the layer thickness control blade 73 to be carried as a thin layer having a given thickness on the development roller 71.

The toner carried on the development roller 71 is fed to the electrostatic latent image formed on the photosensitive drum 51. As a result, the toner adheres to the electrostatic latent image to visualize the electrostatic latent image and form the toner image on the photosensitive drum 51. Then, the sheet S is conveyed to a gap between the photosensitive drum 51 and the transfer roller 63, and the toner image on the photosensitive drum 51 is transferred onto the sheet S. At this time, the untransferred toner remaining on the photosensitive drum 51 is collected by the development roller 71 to be returned to the development unit 7.

The fixation device 8 is disposed behind the process cartridge 5 and mainly includes a heating roller 92 and a pressing roller 91. The sheet S having the toner image transferred thereto passes through the fixation device 8, while being simultaneously heated and pressed between the heating roller 92 and the pressing roller 91, and the toner image is fixed onto the sheet S. The sheet S having passed through the fixation device 8 is ejected onto a paper receiving tray 22.

Configuration of Process Cartridge

Next, a description will be given of each of the units of the process cartridge 5. As described above, the process cartridge 5 includes the photosensitive member unit 6 and the development unit 7 detachable from the photosensitive member unit 6.

Configuration of Development Unit

Figure 2:
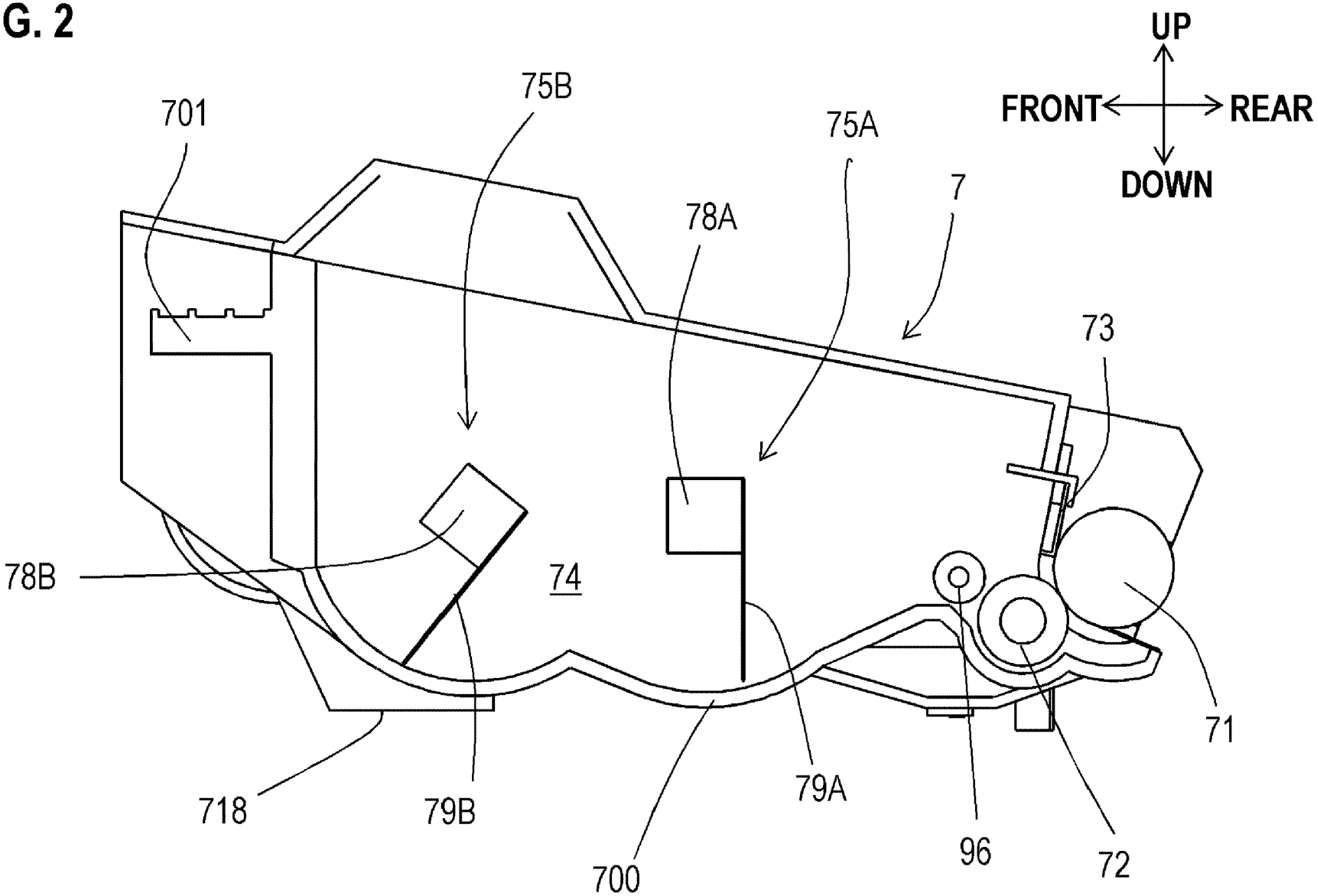
FIG. 2 is a cross-sectional view of a development unit.
Figure 3:
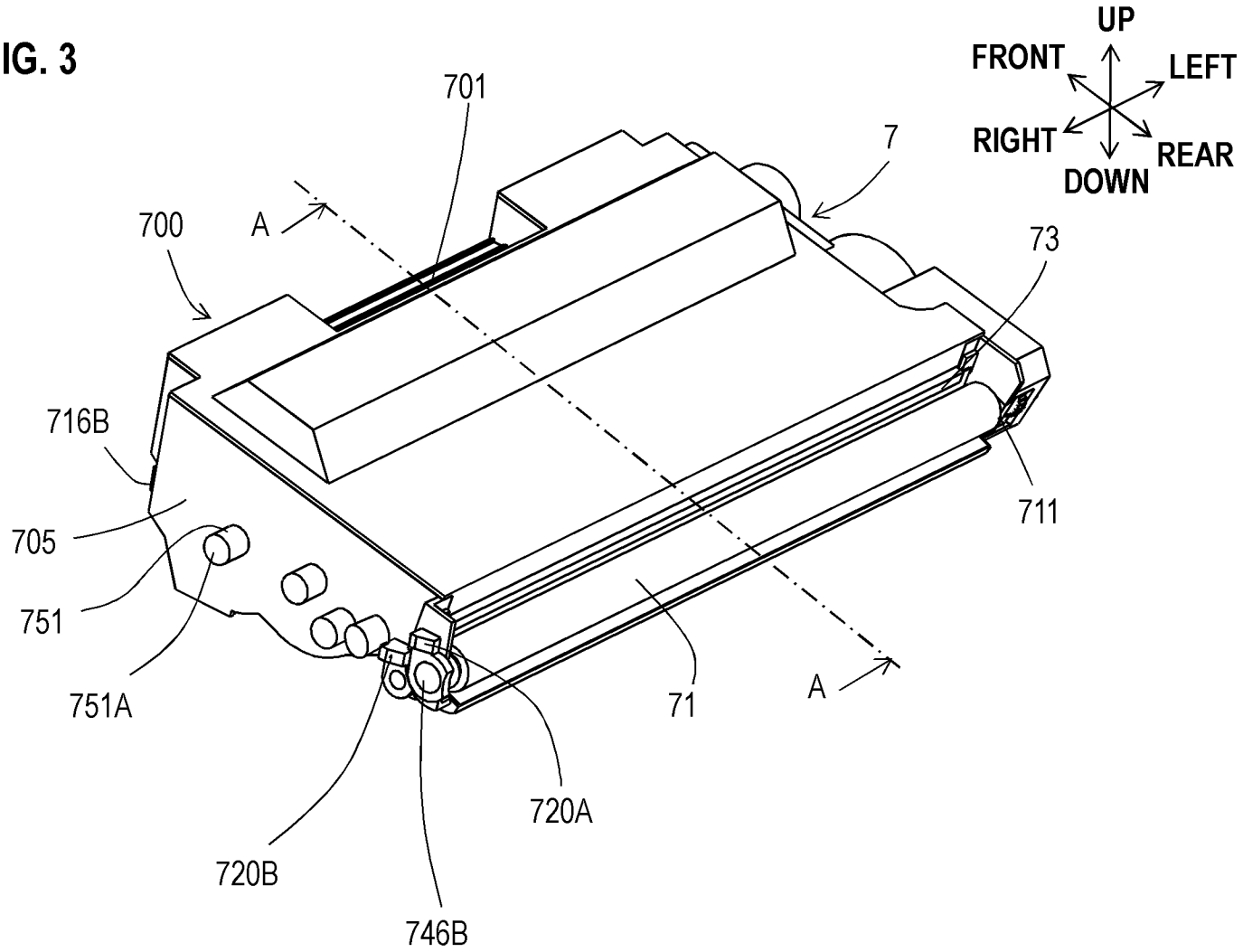
FIG. 3 is a perspective view of the development unit.
Figure 4:
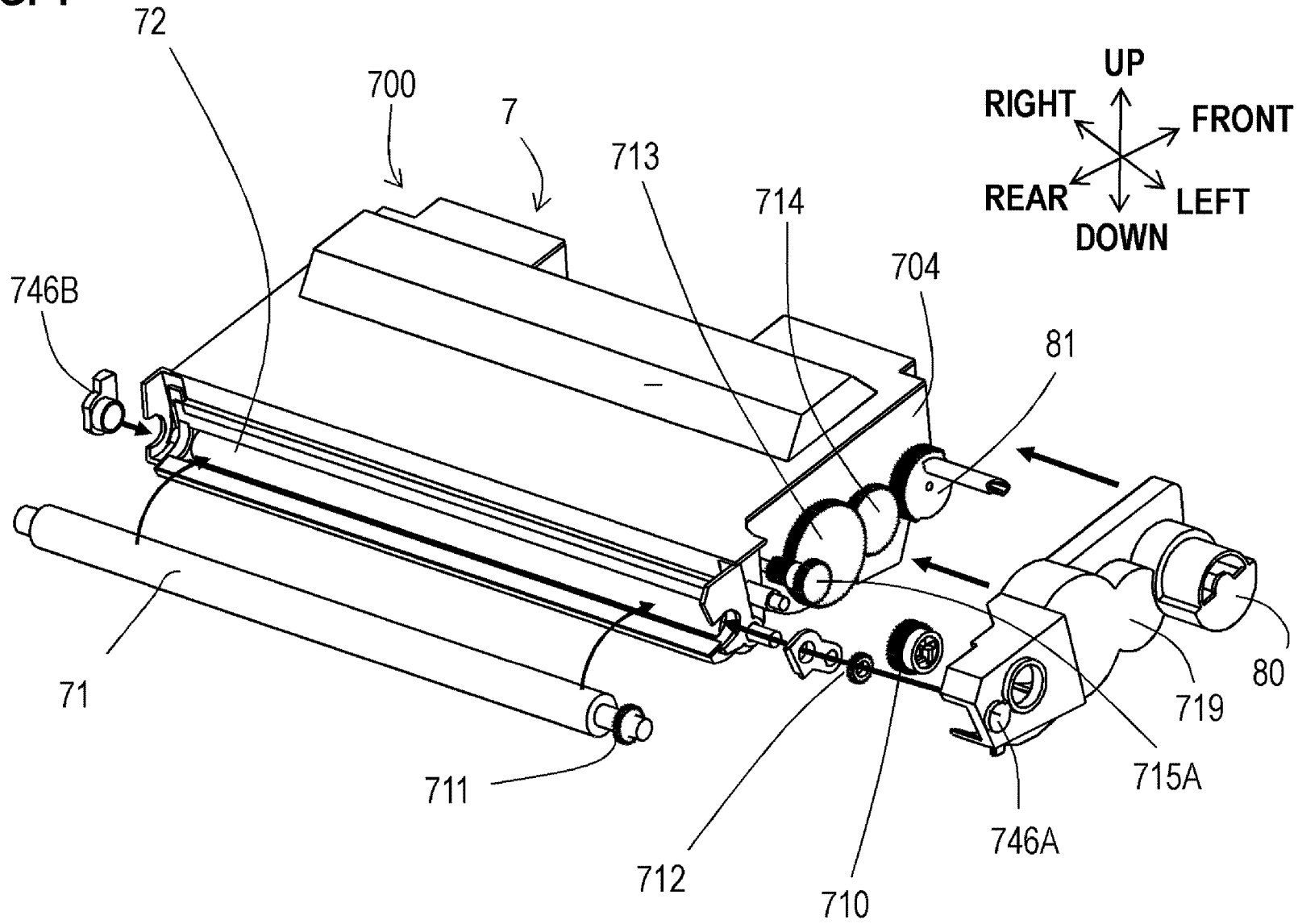
FIG. 4 is an exploded perspective view of the development unit.
Figure 5:
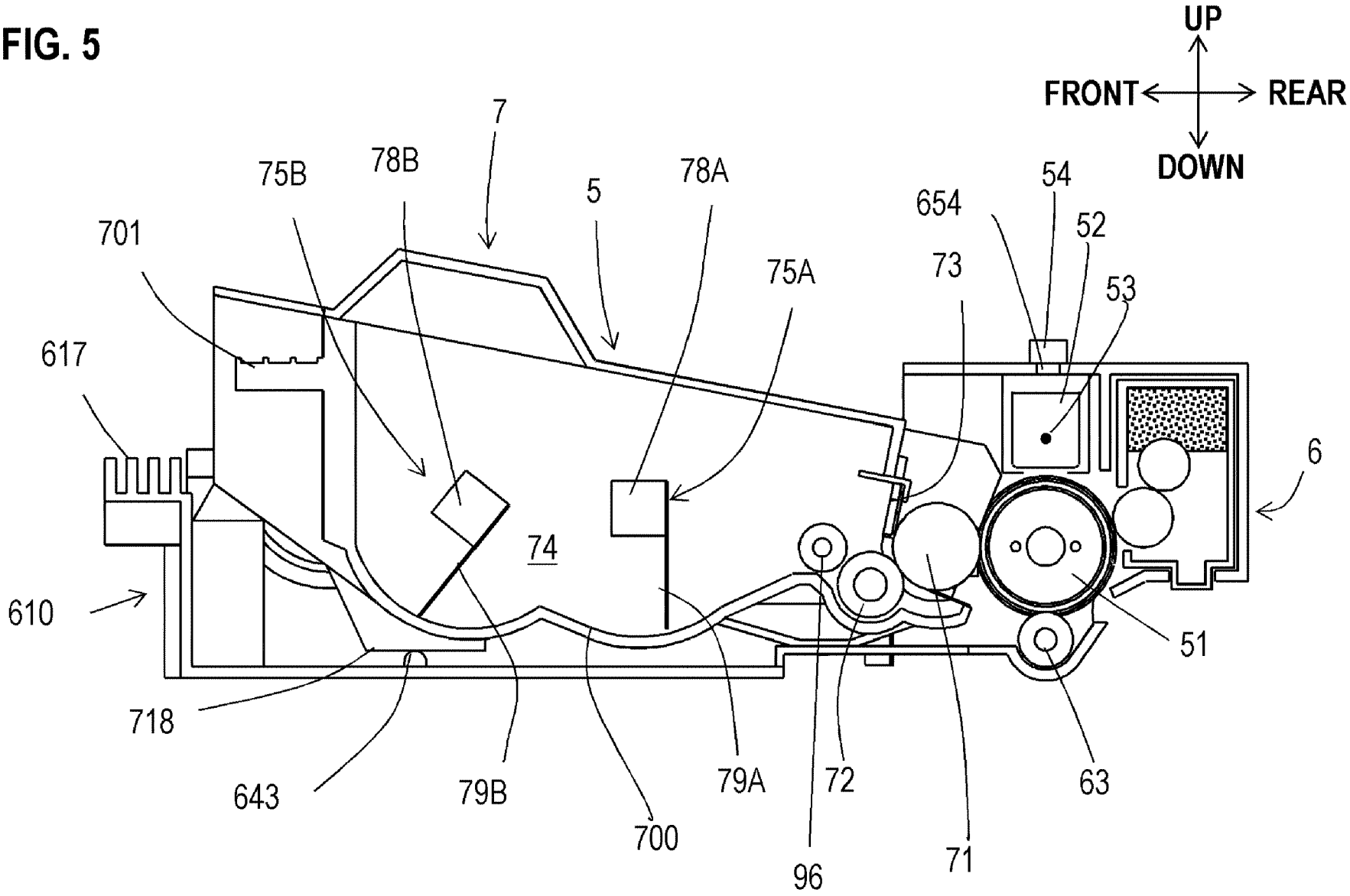
FIG. 5 is a cross-sectional view of the process cartridge.
Figure 9:
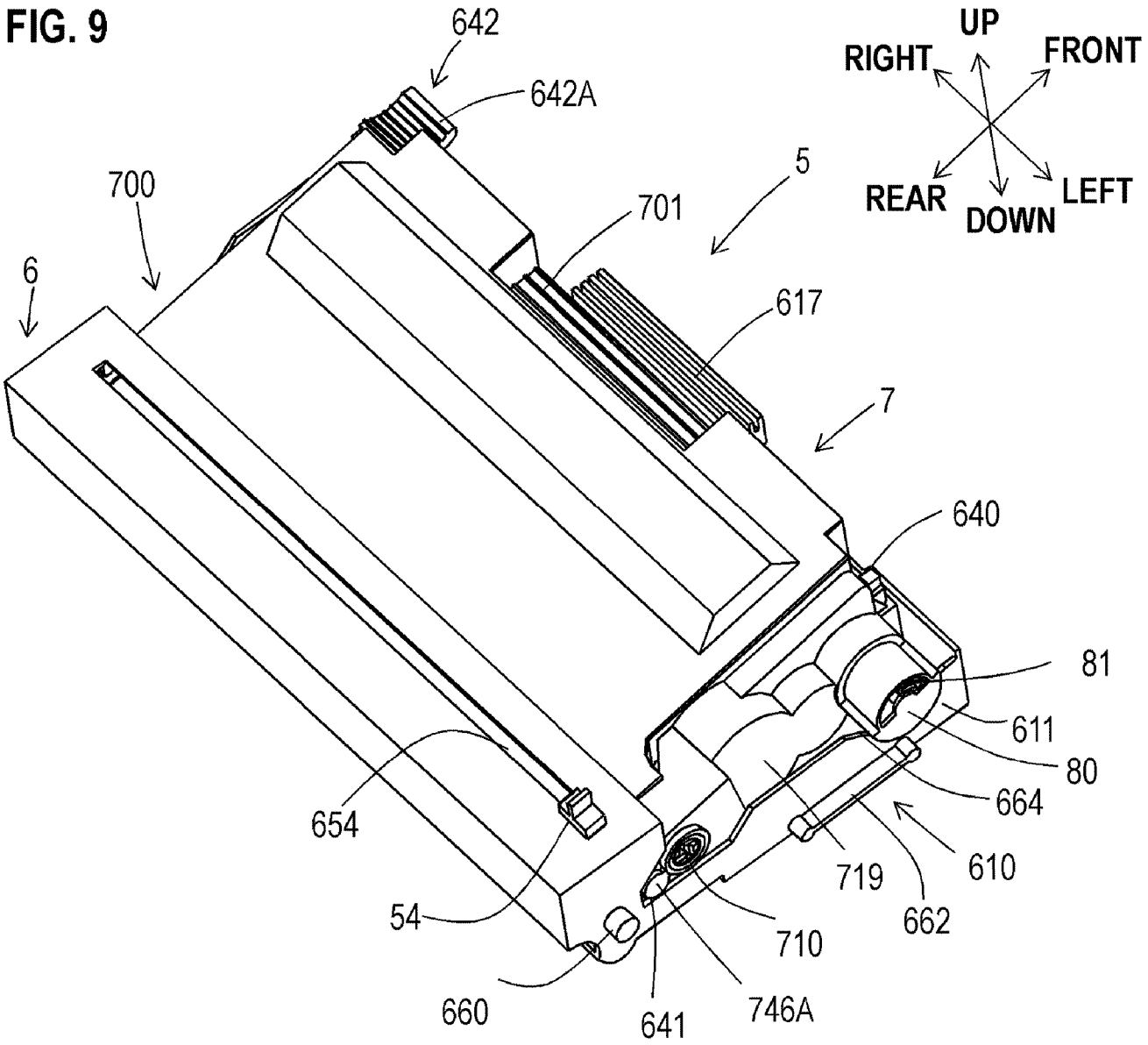
FIG. 9 is a perspective view of the process cartridge.

First, a description will be given of a configuration of the development unit 7. FIG. 2 is a cross-sectional view of the development unit 7, which is a cross-sectional view of an A-A cross section in FIG. 3. FIG. 3 is a perspective view in which the development unit 7 is viewed from above, while FIG. 9 is a perspective view in which the process cartridge 5 is viewed from above. FIG. 4 is an exploded perspective view of the development unit 7. FIG. 5 is a cross-sectional view of the development unit 7 (process cartridge 5) attached to the photosensitive member unit 6, which is parallel with each of the up-down direction and the front-rear direction. FIG. 6 is a top view of the development unit 7 illustrating a state from which a top surface of a housing 700 and a side holder 719 are removed for the sake of explanation.

As illustrated in FIG. 2, the development unit 7 has, in front of the housing 700 serving as a development frame body, a holding portion 701 to be held by the user, while having the development roller 71 rotatively supported behind the holding portion 701. A description will be given below of the configuration of the development unit 7 in which the rotation axis direction of the development roller 71 is referred to as an axial direction.

As illustrated in FIGS. 4 and 6, the development roller 71, the feeding roller 72, the first agitator (first stirring member) 75A, and the second agitator (second stirring member) 75B have respective both ends rotatively supported by a left side wall 704 and a right side wall 705 of the housing 700. On a left side of the left side wall 704 of the housing 700, a development coupling 710, a development roller gear 711, a feeding roller gear 712, a first agitator gear 713, a second agitator gear 714, a development screw gear 715A, and idle gears 715B and 715C are provided. The development roller gear 711 is fixed to an end portion of the development roller 71, while the feeding roller gear 712 is fixed to an end portion of the feeding roller 72. The first agitator gear 713 is fixed to an end portion of a stirring rod 78A (see FIG. 5) of the first agitator 75A, while the second agitator gear 714 is fixed to an end portion of a stirring rod 78B (see FIG. 5) of the second agitator 75B.

As illustrated in FIG. 6, inside the toner containing portion 74 of the development unit 7, a screw 96 is provided.

The screw 96 extends through the right side wall 705 of the toner containing portion 74 to overlap a connection cylinder 98 when viewed in the left-right direction and communicate with the connection cylinder 98. Note that, between the toner containing portion 74 and the connection cylinder 98, a sealing member 99 is interposed. A description will be given later of the connection cylinder 98.

The sealing member 99 has a substantially cylindrical shape. The sealing member 99 prevents a toner leakage through a gap between the toner containing portion 74 and the connection cylinder 98. Even when the development unit 7 rotates with respect to the photosensitive member unit 6 and the toner containing portion 74 and the connection cylinder 98 are displaced from each other when viewed in the left-right direction, the sealing member 99 connects the toner containing portion 74 and the connection cylinder 98 to prevent the toner leakage through the gap between the toner containing portion 74 and the connection cylinder 98.

As illustrated in FIG. 2, the screw 96 is located in the toner containing portion 74. The screw 96 extends in the left-right direction. The screw 96 is an auger screw. The screw 96 has a left end portion extending through the left side wall 704 of the toner containing portion 74 and connected to the development screw gear 715A. The screw 96 has a right end portion rotatively supported by the right side wall 705 of the toner containing portion 74.

As illustrated in FIG. 3, the development unit 7 is provided with a first electric contact point 720A which is electrically connected to the development roller 71 and to which a voltage to be applied to the development roller 71 is fed and a second electric contact point 720B which is electrically connected to the feeding roller 72 and to which a voltage to be applied to the feeding roller 72 is fed. Through contact of these electric contact points with power supply contact points provided in the apparatus main body 2 and not shown, power is fed to the development roller 71 and to the feeding roller 72.

In association with an operation of closing the front door 21 provided in the apparatus main body 2, a development driving transmission member provided in the apparatus main body 2 and not shown moves to a position for engagement with the development coupling 710. Conversely, in association with an operation of openings the front door 21, the development driving transmission member moves to a position for disengagement from the development coupling 710.

After the front door 21 is closed, when the apparatus main body 2 operates, a driving force is transmitted (input) from the development driving transmission member to the development coupling 710 serving as a driving force receiving member to allow the development roller 71 to rotate via a gear provided on a peripheral surface of the development coupling 710 and the development roller gear 711 and allow the feeding roller 72 to rotate via the feeding roller gear 712. The development driving transmission member is configured to be able to tolerate a displacement of the development coupling 710 within a predetermined range and transmit the driving force to the development coupling 710. Each of the development coupling 710, the development roller gear 711, and the feeding roller gear 712 has axial movement thereof restricted by the side holder 719 attached to the housing 700.

The development unit 7 uses two agitators, i.e., the first and second agitators 75A and 75B to stir the toner in the toner containing portion 74. The first agitator 75A includes the stirring rod 78A and a stirring sheet 79A. The first agitator 75A is configured to be able to receive, at the first agitator gear 713, the driving force from the development coupling 710 via the development screw gears 715A and rotate. The second agitator 75B includes the stirring rod 78B and a stirring sheet 79B. The second agitator 75B is configured to be able to receive, at the second agitator gear 714, the driving force from the first agitator gear 713 via the idle gears 715B and 715C and rotate.

The second agitator 75B feeds the toner in the toner containing portion 74 toward the first agitator 75A. The toner located near the first agitator 75A in the toner containing portion 74 is stirred by the first agitator 75A, then fed toward the feeding roller 72, and further fed by the feeding roller 72 to the development roller 71.

As illustrated in FIGS. 4 and 9, at a left end portion of the development unit 7, a detecting unit 80 is provided. The detecting unit 80 is provided so as to allow a detecting mechanism (not shown) provided in the apparatus main body 2 to detect a state of a detecting member 81 provided in the detecting unit 80. It is possible to determine whether the development unit 7 has not been used yet or has already been used based on the state of the detecting member 81.

Figure 15A:
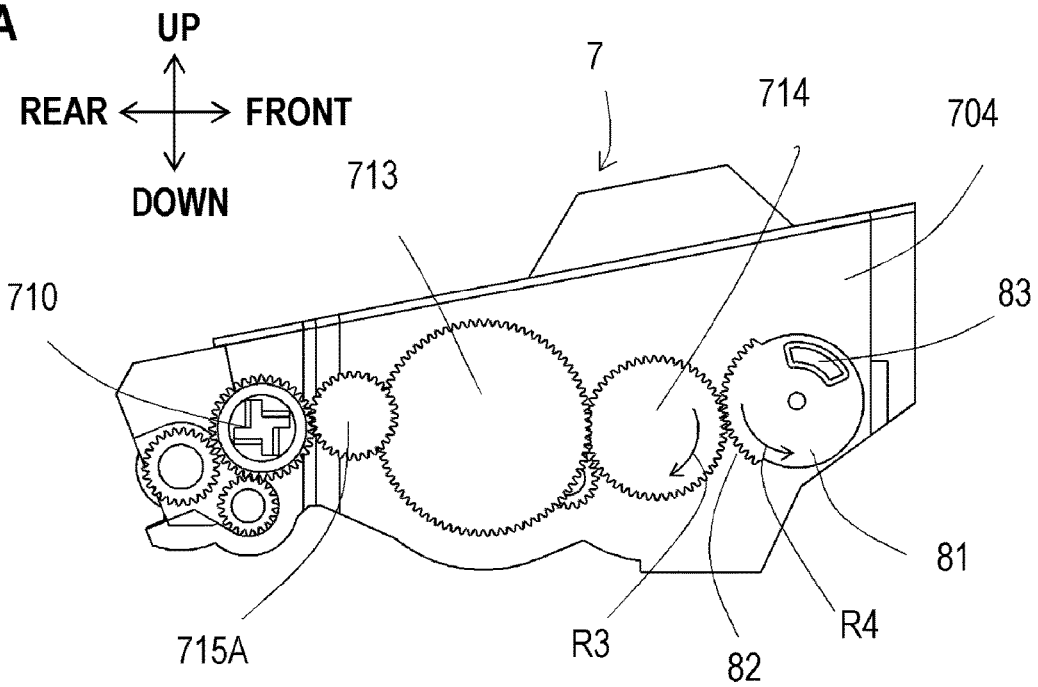
FIGS. 15A and 15B are illustrative views of a detecting member.
Figure 15B:
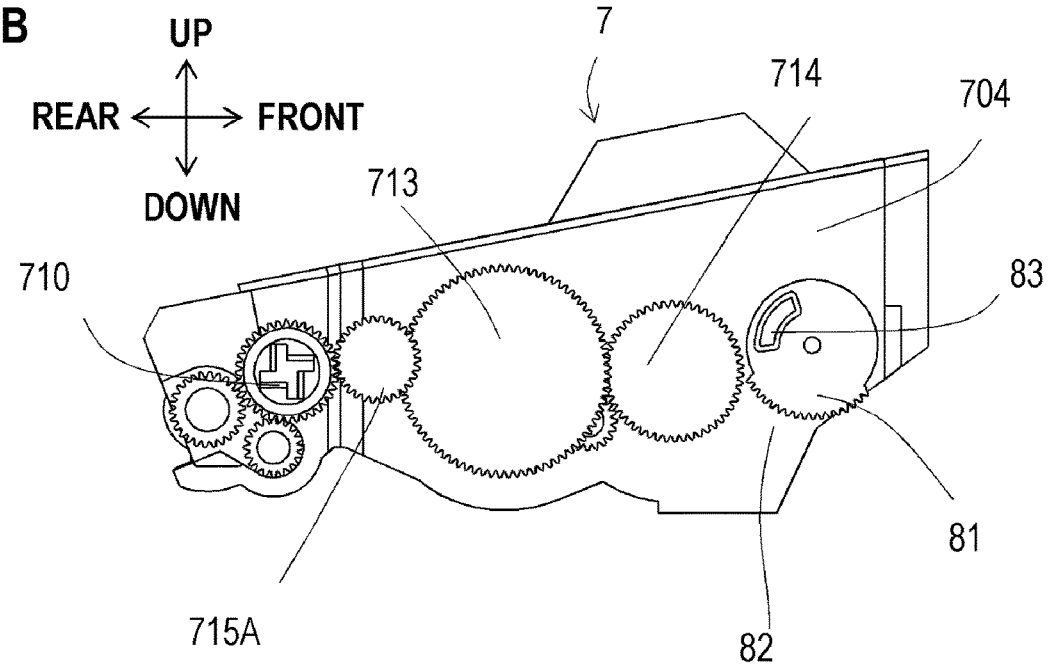

Referring to FIGS. 15A and 15B, an operation of the detecting member 81 will be described. FIGS. 15A and 15B are views in which the development unit 7 is viewed from a left side surface. For the sake of explanation, the side holder 719 has been removed from each of FIGS. 15A and 15B. As illustrated in FIG. 15A, the detecting member 81 is provided with a detecting projection 83 and a detecting gear 82. As illustrated in the drawings, the detecting gear 82 is a chipped tooth gear. The detecting member 81 receives, at the detecting gear 82, the driving force from the second agitator gear 714.

FIG. 15A illustrates a state where the development unit 7 has not been used yet. The detecting projection 83 is located in an upper front portion of the detecting member 81. The detecting gear 82 meshes with the second agitator gear 714. When the development unit 7 is used, by the driving force received by the development coupling 710 from the development driving transmission member of the apparatus main body 2, the second agitator gear 714 rotates in a direction indicated by an arrow R3 in FIG. 15A. At this time, due to the detecting gear 82 meshing with the second agitator gear 714, the detecting member 81 rotates in a direction indicated by an arrow R4 in FIG. 15A. FIG. 15B illustrates a state after the detecting member 81 is rotated. Since the detecting gear 82 is a chipped tooth gear, the detecting member 81 is rotated in a direction indicated by an arrow R4 in FIG. 15B and, when there is no more gear tooth meshing with the second agitator gear 714, the rotation of the detecting member 81 stops. At this time, the detecting projection 83 is located in an upper rear portion of the detecting member 81.

Through detection of a position of the detecting projection 83 of the detecting member 81 by a detecting mechanism (not shown) provided in the apparatus main body 2, it is possible to determine whether the development unit 7 has not been used yet or has already been used.

Figure 16:
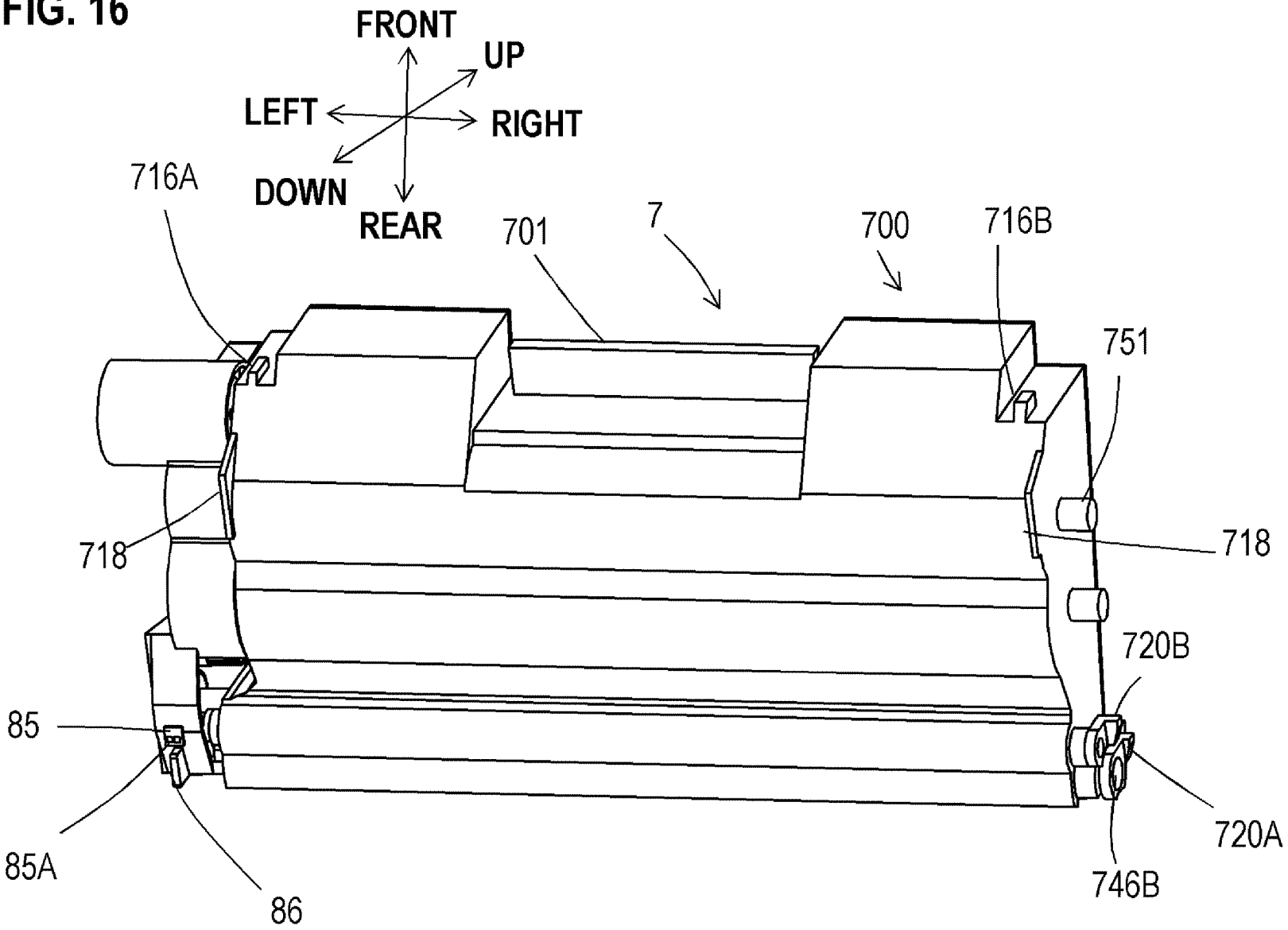
FIG. 16 is a perspective view of the development unit.

FIG. 16 is a perspective view in which the development unit 7 is viewed from below. As illustrated in FIG. 16, a bottom surface of the development unit 7 includes a memory 85 and a positioning projection 86. The memory 85 includes a memory chip (not shown) storing therein information related to the development unit 7 and a memory electrode 85A conductive with the memory chip. The memory electrode 85A comes into contact with an electrode provided in the apparatus main body 2 and not shown to provide communication between the memory chip and the apparatus main body 2.

Configuration of Photosensitive Member Unit and Supporting of Development Unit

Figure 17:
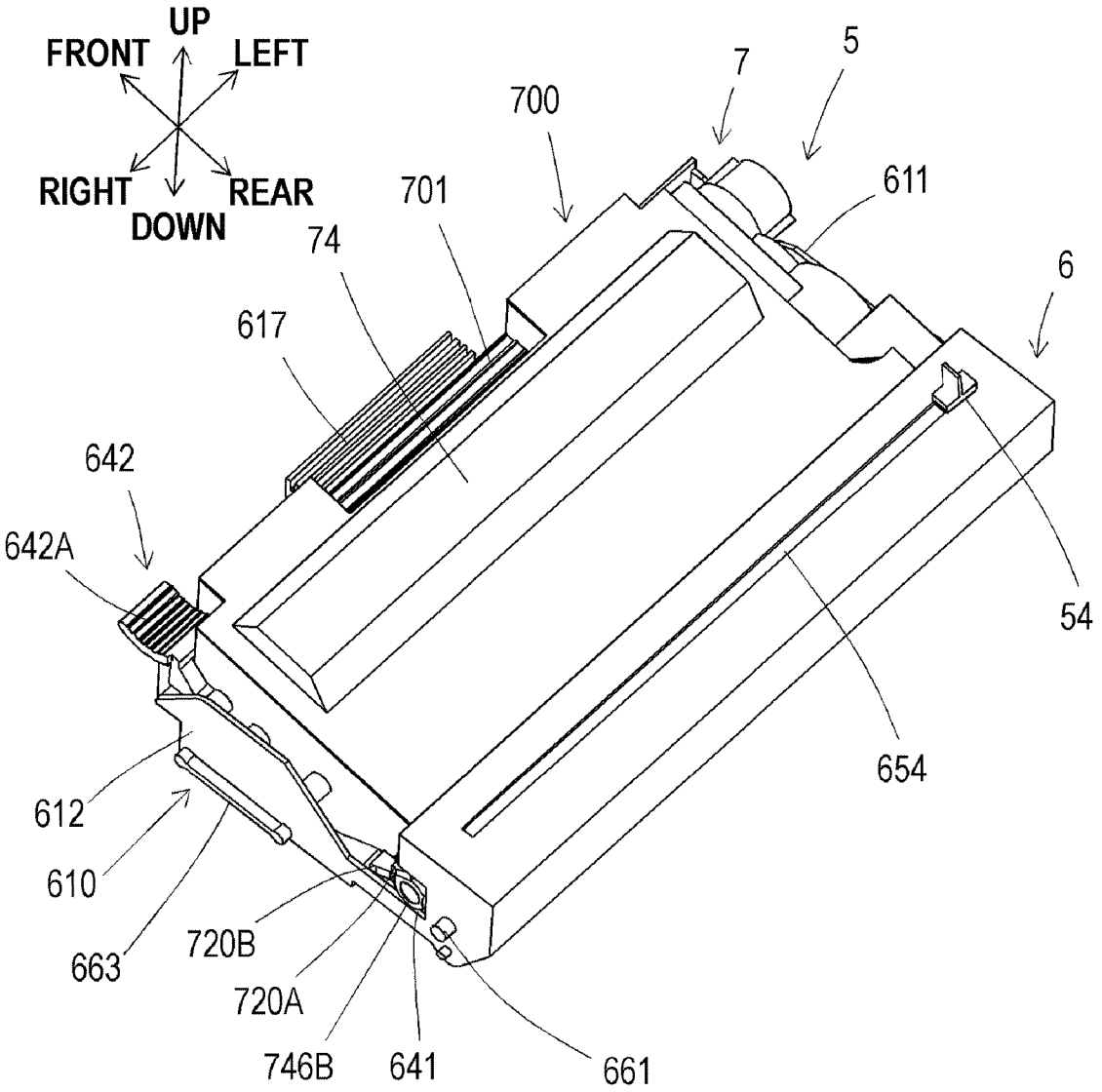
FIG. 17 is a perspective view of the process cartridge.
Figure 18A:
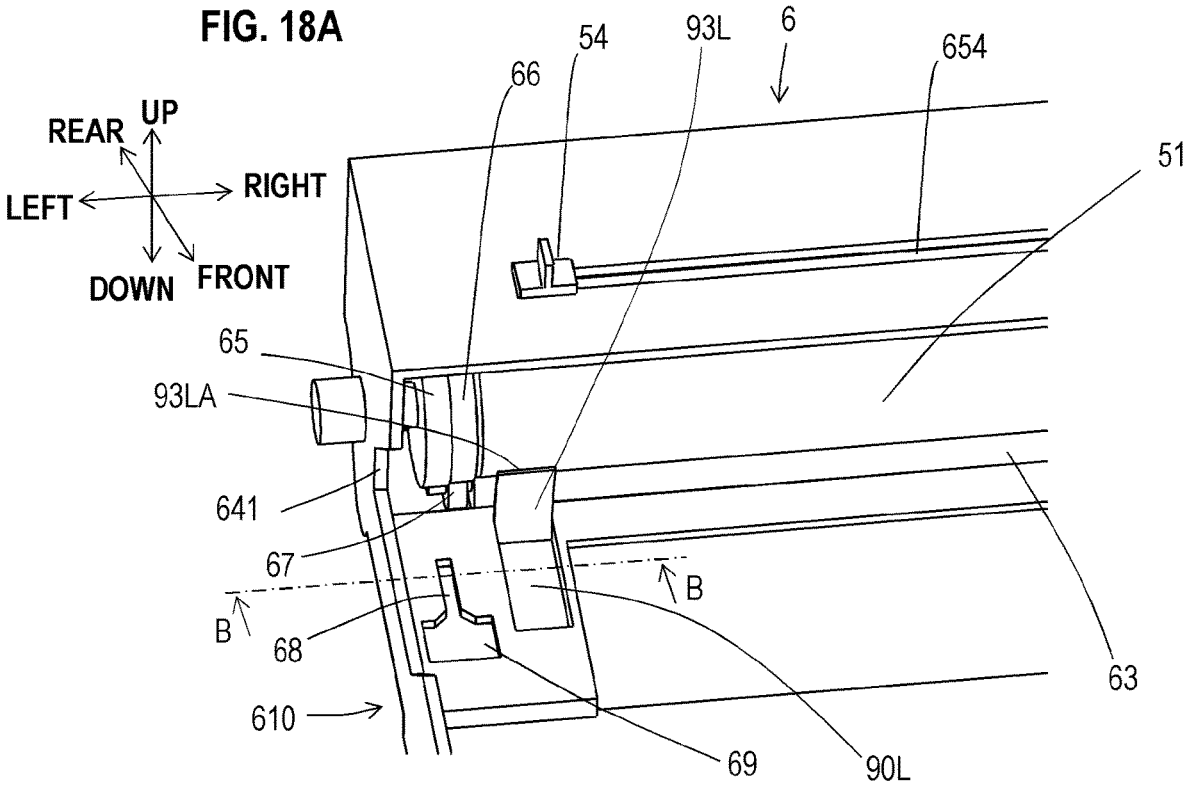
FIGS. 18A and 18B are partial perspective views of a photosensitive member unit.
Figure 18B:
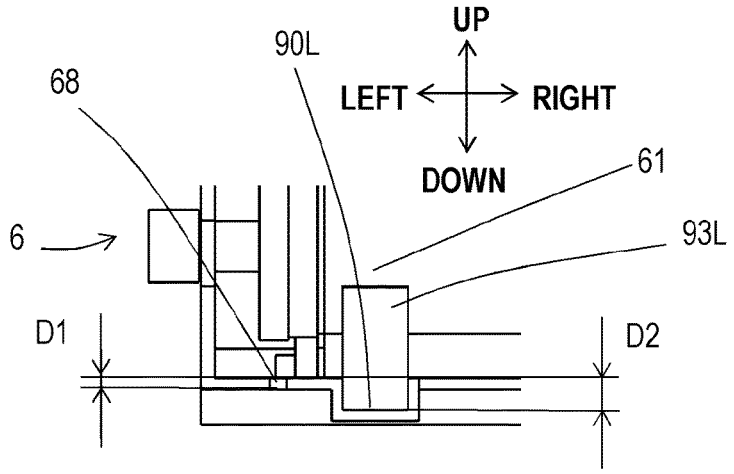
Figure 19:
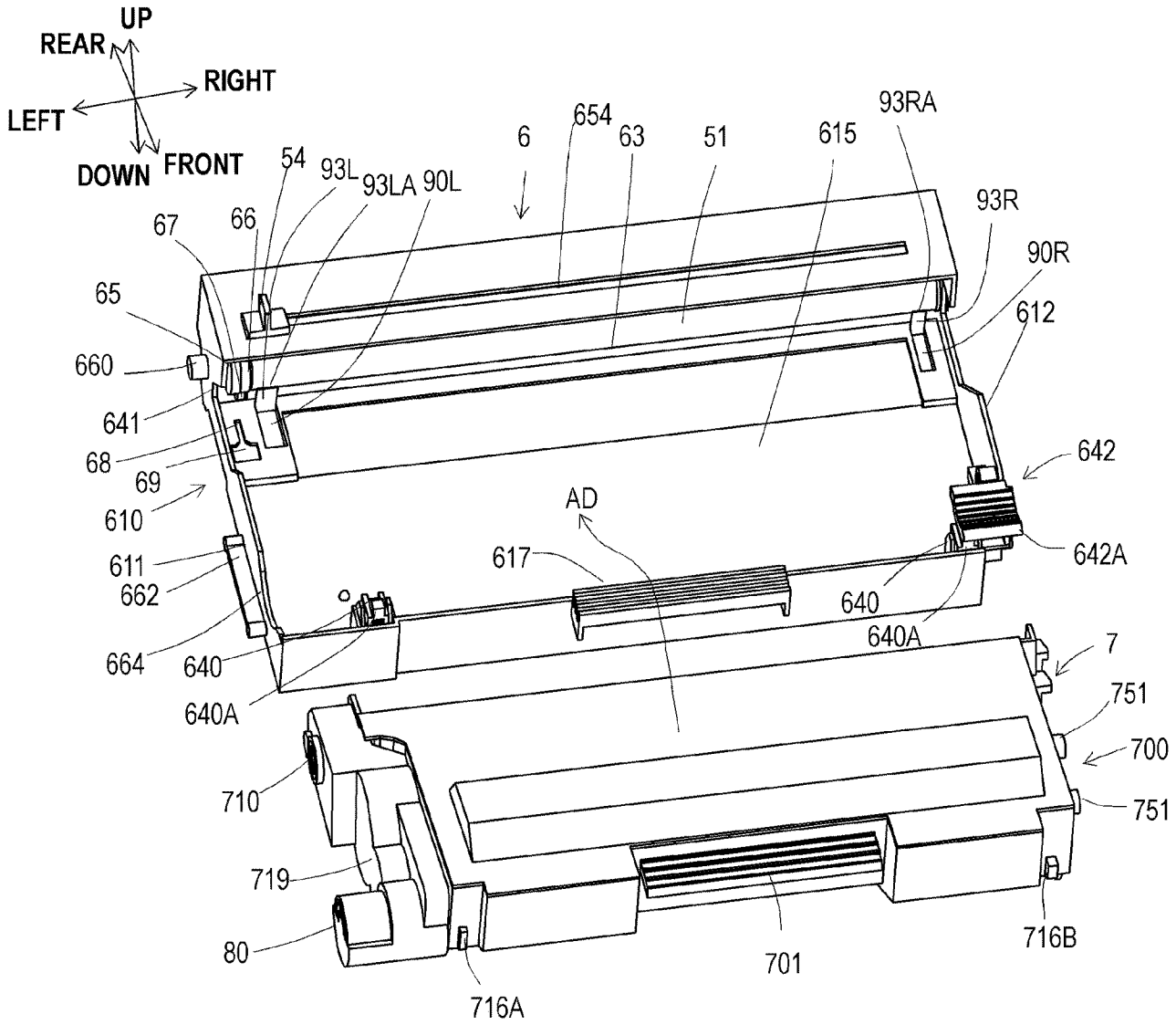
FIG. 19 is a perspective view of the development unit and the photosensitive member unit.
Figure 20:
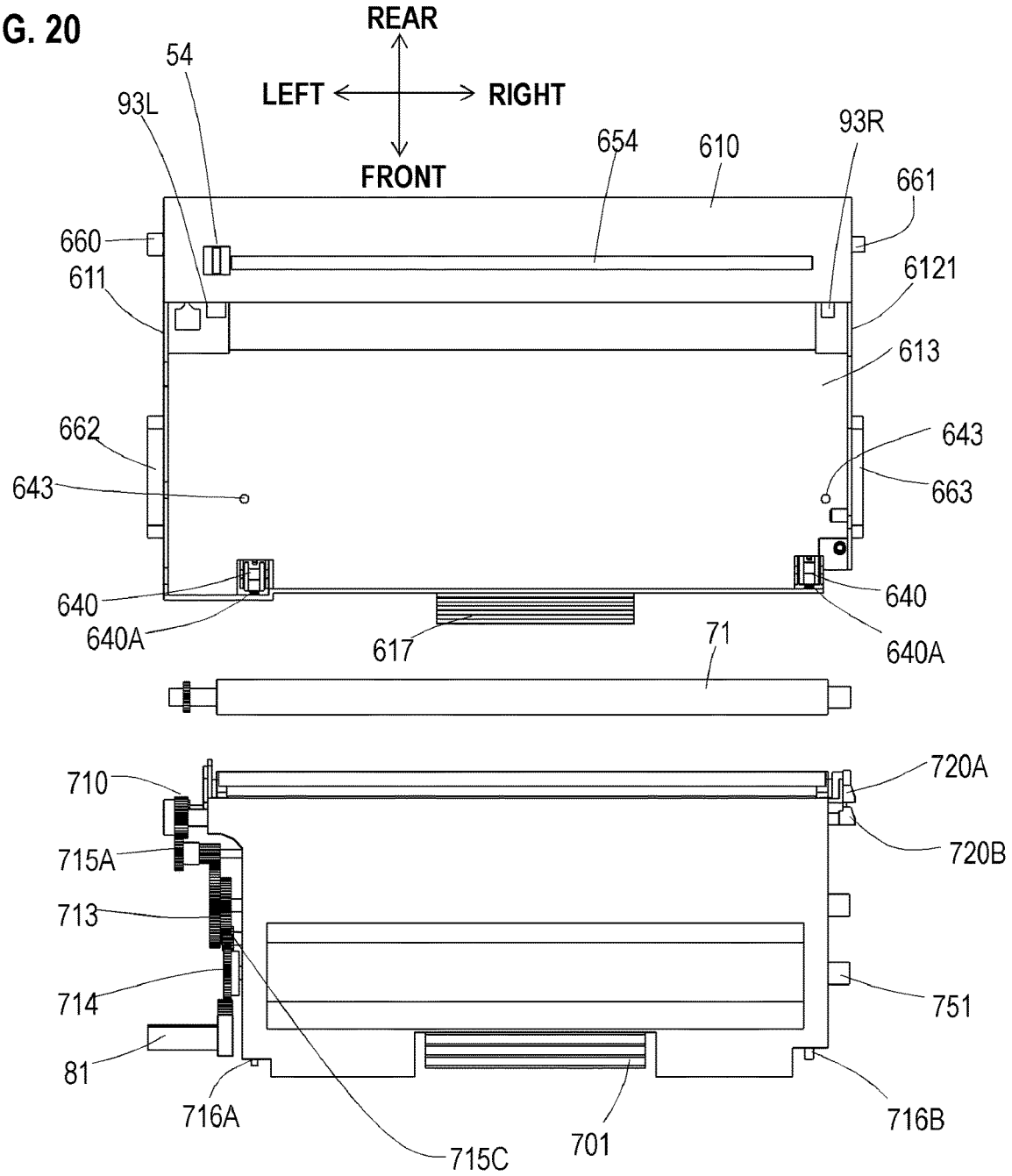
FIG. 20 is a top view of the development unit and the photosensitive member unit.
Figure 21A:
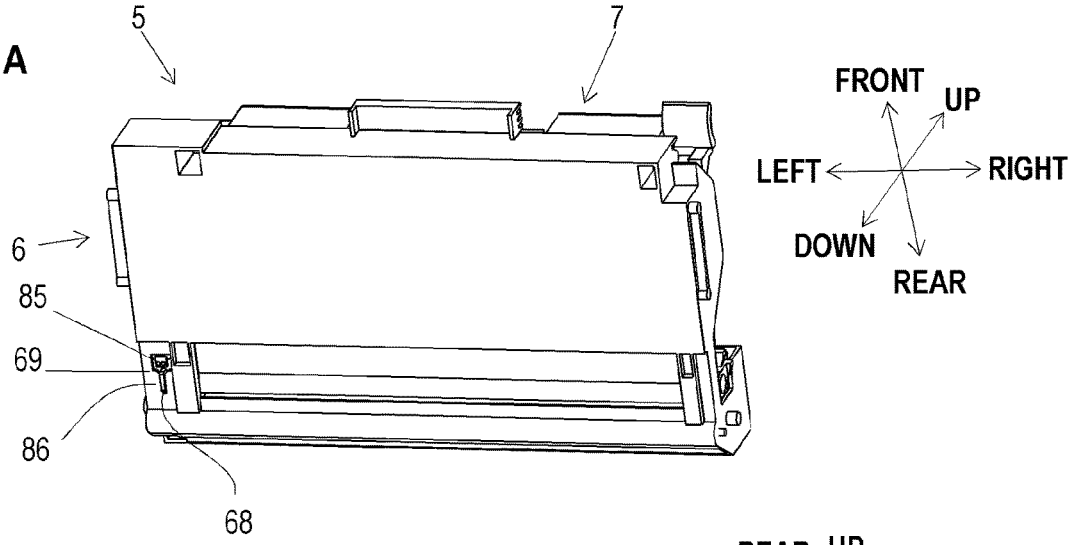
FIGS. 21A and 21B are perspective views of the process cartridge.
Figure 21B:
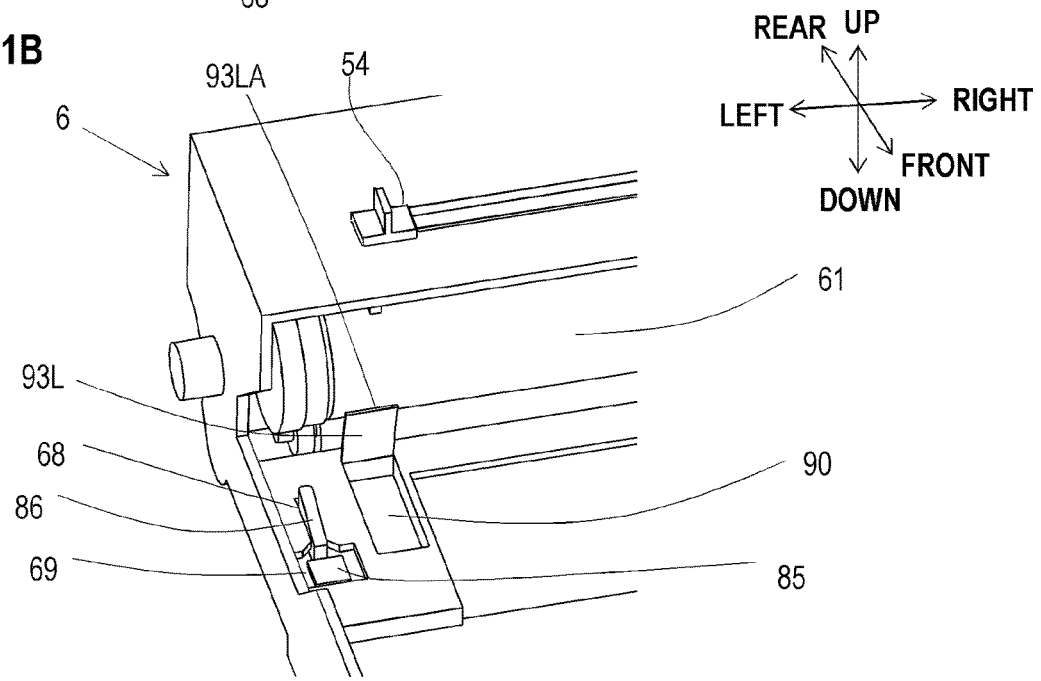

Next, a description will be given of a detailed configuration of the photosensitive member unit 6. FIG. 17 is a perspective view of the process cartridge 5. FIG. 18A is a partial perspective view of the photosensitive member unit 6, while FIG. 18B is a cross-sectional view of a B-B cross section in FIG. 18A. FIG. 19 is a perspective view of the development unit 7 and the photosensitive member unit 6. FIG. 20 is a top view illustrating layout relationships among the photosensitive member unit 6, the development unit 7, and the development roller 71 in the left-right direction. FIG. 21A is a perspective view in which the process cartridge 5 is viewed from below, while FIG. 21B is a perspective view of the development unit 7 and a positioning portion in the axial direction of the photosensitive drum 51 of the photosensitive member unit 6. For the sake of explanation, FIG. 21B illustrates only the positioning projection 86 and the memory 85 of the development unit 7.

As illustrated in FIG. 17, the photosensitive member unit 6 mainly includes a frame 610 having a pair of a left side wall 611 and a right side wall 612 and the photosensitive drum 51 rotatively supported behind the frame 610. In front of the frame 610, an attachment portion 615 (see FIG. 19) to which the development unit 7 can be attached, a holding portion 617 with which the user holds the photosensitive member unit 6, pressing members 640 that press the development unit 7, and a lifting member (movement member) 642 that lifts up the development unit 7 are provided. The lifting member 642 lifts up the development unit 7 attached to the attachment portion 615. Between the left side wall 611 and the right side wall 612 in the left-right direction, the toner containing portion 74 of the development unit 7 attached to the attachment portion 615 is disposed.

Behind the frame 610, a first positioning projection 660 projecting coaxially with the photosensitive drum from the left side wall 611 and a first guide rib 662 are provided. Likewise, a second positioning projection 661 projecting coaxially with the photosensitive drum from the right side wall 612 and a second guide rib 663 are provided (see FIGS. 20 and 17).

A life of the development unit 7 which is determined by an amount of the toner contained in the development unit 7 is set shorter than a life of the photosensitive member unit 6 determined by a thickness of a photosensitive layer of the photosensitive drum 51. Accordingly, it is necessary to exchange only the development unit 7 that has reached the end of the life thereof separately from the photosensitive member unit 6. In that case, the front door 21 is opened, the process cartridge 5 is taken out of the inside the apparatus main body 2, the development unit 7 that has reached the end of the life is detached from the photosensitive member unit 6, and then another development unit 7 is attached to the photosensitive member unit 6, as indicated by an attachment direction AD in FIG. 19. Then, the photosensitive member unit 6 having the development unit 7 attached thereto is attached as the process cartridge 5 to the apparatus main body 2.

As illustrated in FIGS. 9, 17, and 19, the left side wall 611 and the right side wall 612 of the frame 610 have respective receiving portions 641 for receiving rotation bearing members 746A and 746B of the development roller 71 which are formed in front of the photosensitive drum 51. Each of the receiving portions 641 is a recessed portion having a substantially U-shaped shape having a front side thereof open when viewed from the left side. In a process of the attachment of the development unit 7 to the photosensitive member unit 6, a rotation shaft 746 of the development roller 71 is inserted into the receiving portions 641. The receiving portions 641 guide movement of the development unit 7 in the attachment direction AD illustrated in FIG. 19, while supporting the development unit 7 with respect to the photosensitive member unit 6.

As illustrated in FIG. 20, respective projecting portions 643 projecting upward are provided at both end portions of a bottom surface 613 of the frame 610 in the left-right direction. The projecting portions 643 come into contact with ribs 718 provided on a bottom portion of the housing 700 of the development unit 7 illustrated in FIG. 16 to movably support the development unit 7.

As illustrated in FIG. 18A, the photosensitive member unit 6 has a positioning hole 68 provided in the frame 610 and a contact opening 69 provided on one end side in the rotation axis direction (left-right direction) of the photosensitive drum 51. The one end side mentioned herein indicates the same side of a bisector of a length of the photosensitive drum 51 in the left-right direction. When the development unit 7 is disposed on the photosensitive member unit 6, as illustrated in FIGS. 18A and 18B, the positioning projection 86 of the development unit 7 is inserted into the positioning hole 68 of the photosensitive member unit 6. The positioning projection 86 and the positioning hole 68 are engaged with each other in the axial direction (left-right direction) of the photosensitive drum 51 to determine a position of the development unit 7 with respect to the photosensitive member unit 6 in the left-right direction. The memory 85 of the development unit 7 is exposed in the lower part of the process cartridge 5 via the contact opening 69 of the photosensitive member unit 61.

It is to be noted herein that, as illustrated in FIGS. 18A and 18B, in the frame 610 of the photosensitive member unit 6, a box-shaped recessed portion 90L is provided on one end side in the rotation axis direction (left-right direction) of the photosensitive drum 51. The recessed portion 90L is provided at a position overlapping the positioning hole 68 when viewed in the rotation axis direction (left-right direction) of the photosensitive drum 51. The recessed portion 90L reinforces a portion around the positioning hole 68 having a strength reduced by the positioning hole 68 provided therein and enhances the strength thereof. As illustrated in FIG. 18B, a depth D2 of the recessed portion 90L is larger than a depth D1 of the positioning hole 68 to increase a reinforcing effect. This configuration enhances the strength of a periphery of the positioning hole 68 of the photosensitive member unit 6 and increases accuracy of positioning of the development unit 7 and the photosensitive member unit 6 in the left-right direction by the positioning projection 86 of the development unit 7 and the positioning hole 68 of the photosensitive member unit 6. As a result, positional accuracy of the memory electrode 85A of the memory 85 and the electrode provided in the apparatus main body 2 is increased to be able to achieve reliable contact between the electrodes.

As illustrated in FIGS. 18A and 18B, on a photosensitive drum 51 side of the recessed portion 90L, a sheet member 93L is provided. The sheet member 93L has a tip portion 93LA in contact with the photosensitive drum 51. This configuration allows the tip portion 93LA to scrape off a foreign material such as the unneeded toner or paper powder deposited on the surface of the photosensitive drum 51 during image formation and thereby prevent a defective image. In this configuration, the foreign material scraped off such as the unneeded toner or paper powder falls into the recessed portion 90L to be collected. Consequently, it is possible to prevent a defective image from being formed by contamination of the process cartridge 5 due to scattering of the foreign material or by the falling of the foreign material onto the sheet S. By thus using the recessed portion 90L for structure reinforcement and foreign material collection, there is no more need to provide a configuration for foreign material collection other than the recessed portion 90L, and it is possible to reduce a size of the cartridge and simplify the configuration thereof.

As illustrated in FIG. 19, on the opposite side of the positioning hole 68 of the photosensitive member unit 6 in the left-right direction, a foreign material box 90R including a box-shaped recessed portion is provided. On the photosensitive drum 51 side of the foreign material box 90R, a sheet member 93R is provided. The sheet member 93R has a tip portion 93RA in contact with the photosensitive drum 51. Similarly to the sheet member 93L described above, the sheet member 93R uses the tip portion 93RA to scrape off the foreign material such as the unneeded toner or paper powder deposited on the surface of the photosensitive drum 51 during the image formation to prevent a defective image. The foreign material scraped off such as the unneeded toner or paper powder falls into the foreign material box 90R to be collected in the box.

As illustrated in FIG. 19, the pressing members 640 are located in front of the frame 610 and provided at both end portions of the frame 610 in the left-right direction. The pressing members 640 are biased in a direction from the front to the rear by compression springs 640A each serving as a biasing member. Consequently, biasing forces of the compression springs 640A cause the pressing members 640 to press pressing target ribs 716A and 716B provided in the housing 700 of the development unit 7. By using the pressing members 640 to press the development unit 7, the development roller 71 is biased toward the photosensitive drum 51.

As illustrated in FIGS. 19 and 9, in the left side wall 611 of the photosensitive member unit 6, a recessed portion 664 is provided, and the detecting unit 80 of the development unit 7 is located therein. Since the recessed portion 664 reduces rigidity of the frame 610, the first guide rib 662 is disposed under the recessed portion 664 such that a portion of the first guide rib 662 overlaps the recessed portion 664. The first guide rib 662 functions as a reinforcing member and can thus reduce the reduction in the rigidity of the frame 610.

As illustrated in FIGS. 18A and 18B, a photosensitive member gear (first gear) 65 and a transfer gear (second gear) 66 are configured to be fixed to a left end portion of the photosensitive drum 51 and rotate integrally with the photosensitive drum 51. When the process cartridge 5 is attached to the apparatus main body 2, a drive gear (not shown) of the apparatus main body 2 meshes with the photosensitive member gear 65 to transmit a driving force to each of the photosensitive drum 51 and the transfer gear 66 and provide a rotative state. In addition, the transfer gear 66 meshes with a transfer roller gear (third gear) 67 fixed to a left end portion of the transfer roller 63 to bring even the transfer roller 63 into a rotative state.

Lifting Mechanism of Development Unit 7

Figure 22:
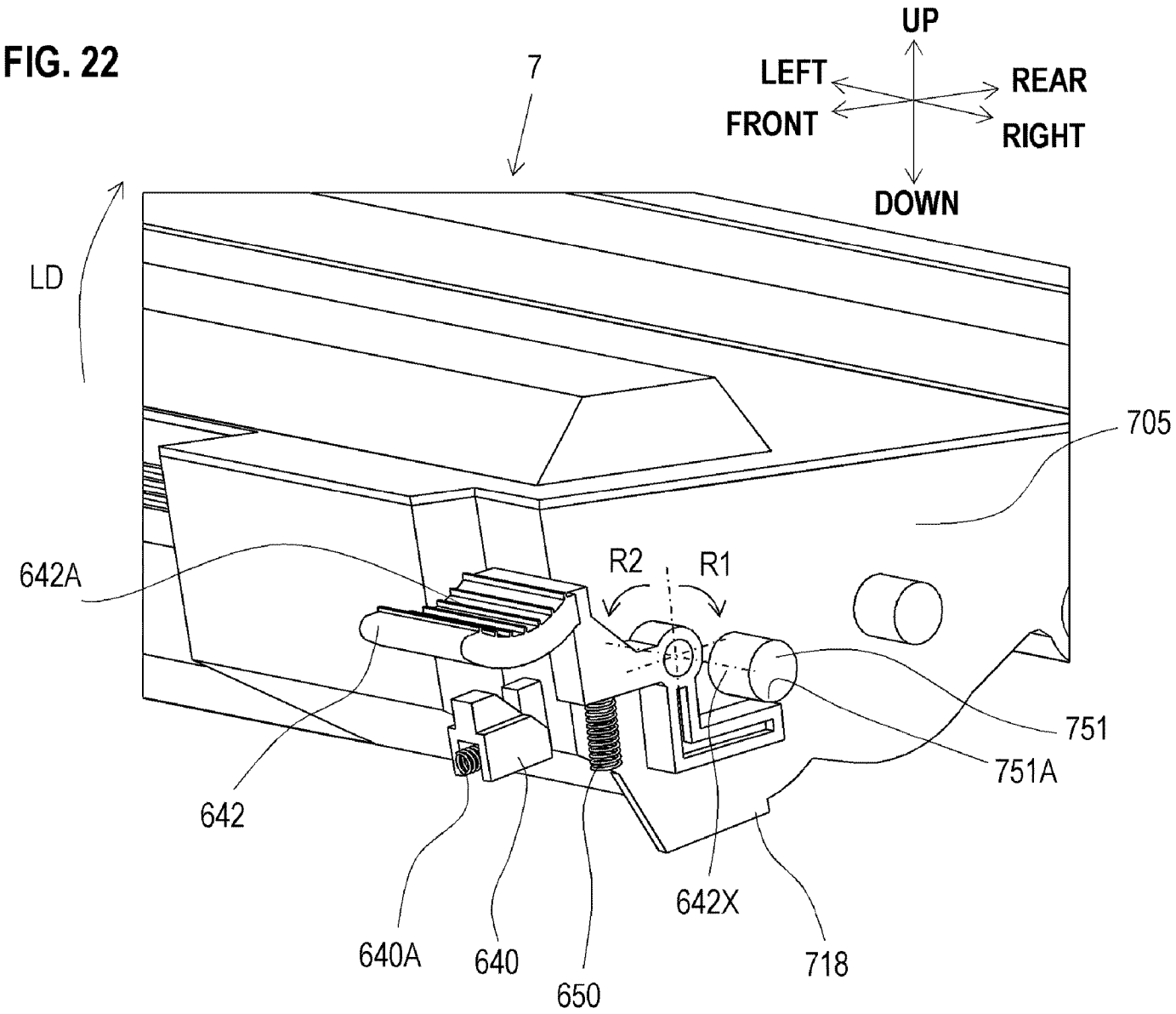
FIG. 22 is a partial perspective view of the development unit and a lifting member.
Figure 23A:
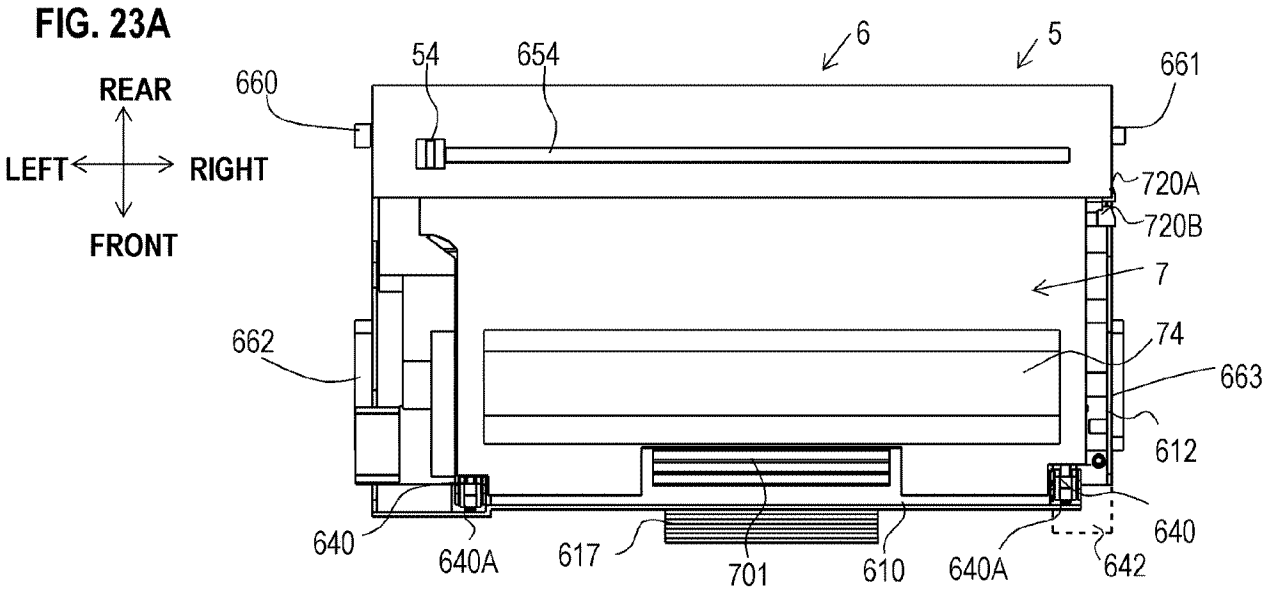
FIGS. 23A and 23B are views illustrating a positional relationship between the lifting member and a pressing member.
Figure 23B:
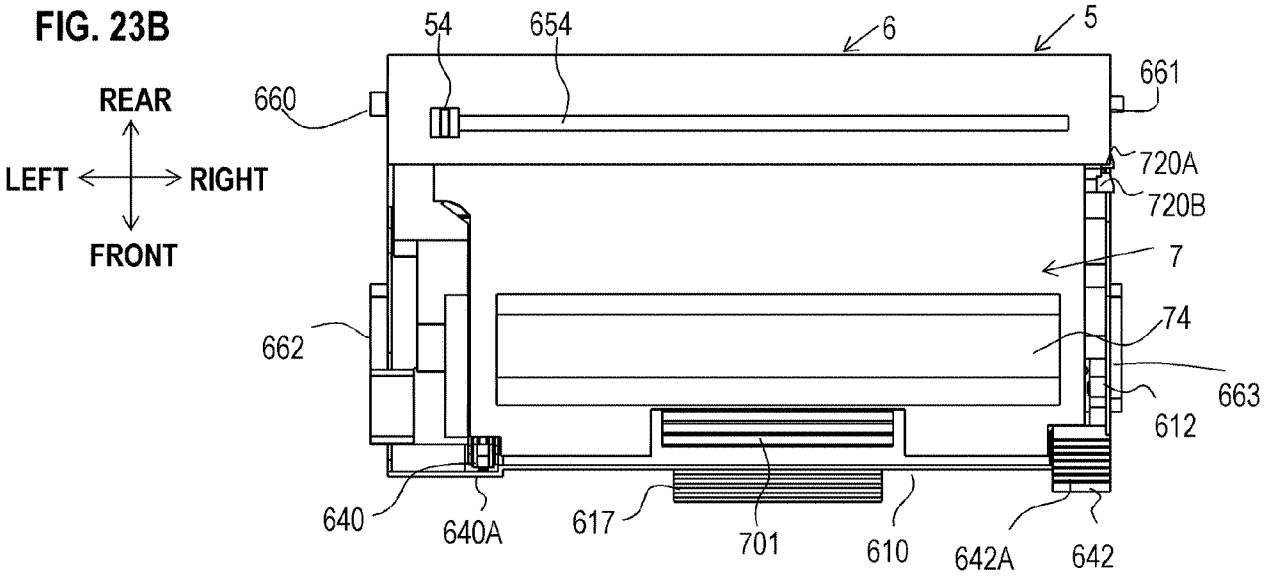
Figure 24A:
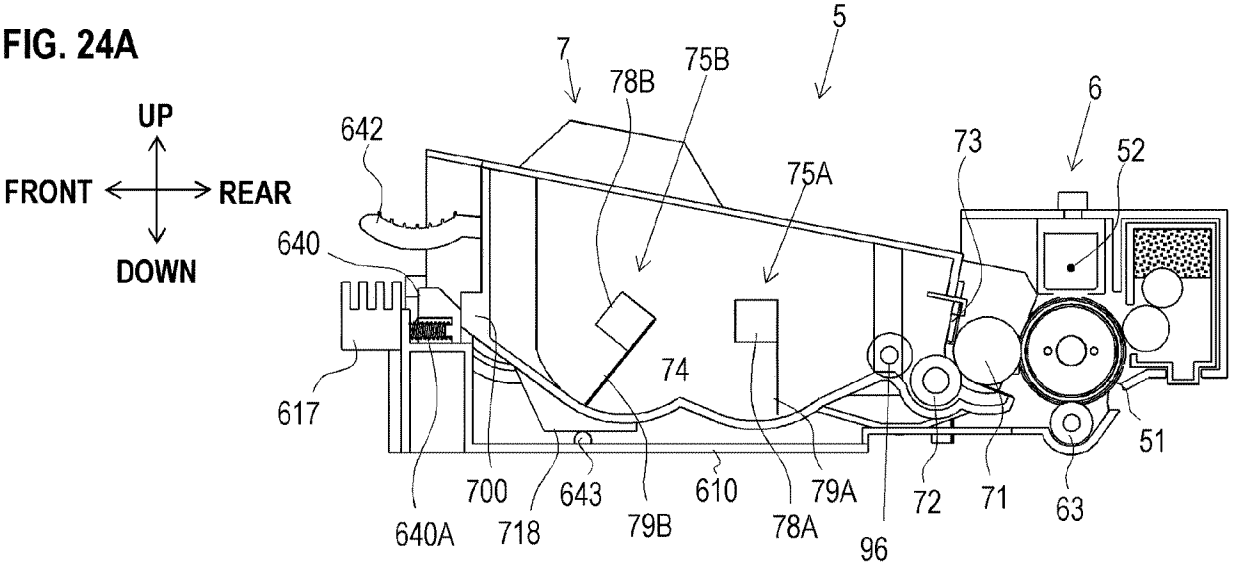
FIGS. 24A and 24B are views illustrating detachment of the development unit.
Figure 24B:
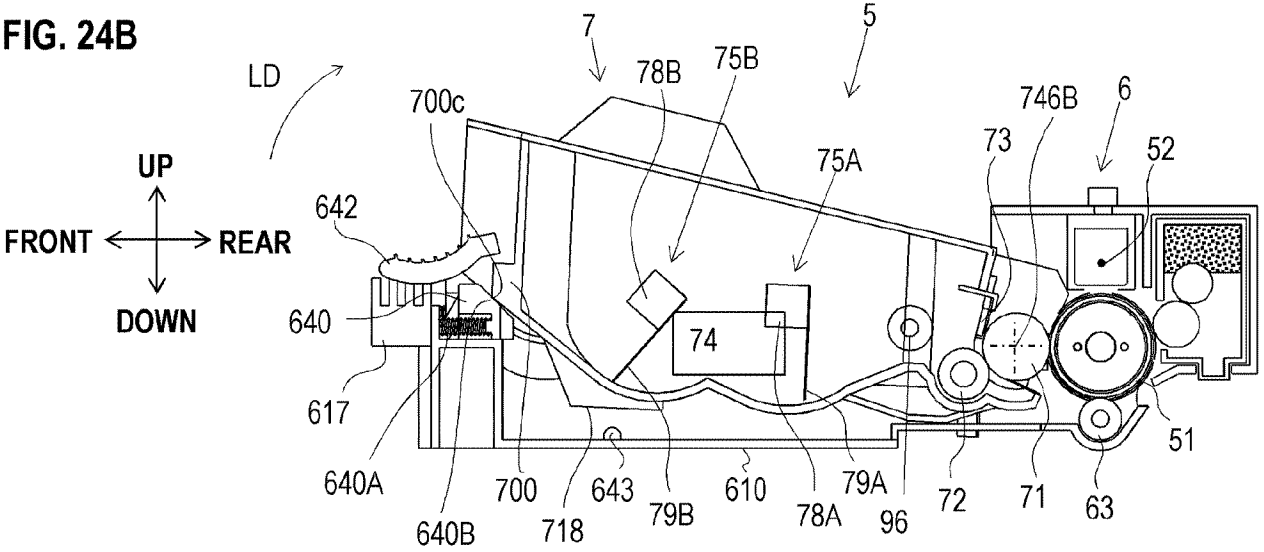

FIG. 22 is a partial perspective view of the development unit 7 and the lifting member 642. FIGS. 23A and 23B are top views of the photosensitive member unit 6 having the development unit 7 attached thereto. FIG. 23A illustrates the lifting member 642 in a see-through state, while FIG. 23B illustrates the lifting member 642 in a non-see-through state. FIGS. 24A and 24B are cross-sectional views of the photosensitive member unit 6 and the development unit 7, and respective cross sections thereof are parallel with the up-down direction and in the front-rear direction. FIG. 24A illustrates a state where the development unit 7 is attached to the photosensitive member unit 6. FIG. 24B illustrates a state where the development unit 7 is placed on the photosensitive unit 6.

The development unit 7 attached to the photosensitive member unit 6 is brought into a lift-up state by a lifting mechanism and then detached from the photosensitive member unit 6. A detailed description will be given below of the lifting mechanism.

As illustrated in FIGS. 22, 24A, and 24B, at least a portion of the lifting member 642 is disposed in front of the housing 700 of the development unit 7 and rotatively supported by the right side wall 612, while receiving the force of a compression spring 650. Also, at least a portion of the lifting member 642 is disposed to overlap the right side wall 705 of the housing 700 containing therein the toner and the pressing members 640 in the front-rear direction. A rotation axis 642X of the lifting member 642 is parallel with the left-right direction (axial direction of the photosensitive drum 51). The lifting member 642 is biased by the force of the compression spring 650 to rotate in a direction R1.

The user presses an operation portion 642A of the lifting member 642 against the force of the compression spring 650 to rotate the lifting member 642 in a direction R2, and consequently the lifting member 642 presses a projecting portion 751 to move the development unit 7 in a detachment direction LD in which the development unit 7 is detached from the photosensitive member unit 6. This provides a state where the development unit 7 can be detached from the photosensitive member unit 6. The operation portion 642A is disposed on a right end side (one end side) of the photosensitive member unit 6.

As illustrated in FIG. 24A, in an attached state where the development unit 7 is attached to the photosensitive member unit 6, the pressing members 640 press the housing 700 and thus press the development roller 71 against the photosensitive drum 51. In addition, the pressing members 640 lock the development unit 7 to prevent the development unit 7 from being detached from the photosensitive member unit 6.

As illustrated in FIG. 22, one end of the lifting member 642 upwardly moves a contact surface (contact portion) 751A of the projecting portion 751 of the housing 700. This moves the development unit 7 from an attachment position where the development unit 7 is attached to the attachment portion 615 (see FIGS. 24A and 24B) in the detachment direction LD and allows the development unit 7 to be detached from the photosensitive member unit 6.

As illustrated in FIG. 24B, when a front portion of the development unit 7 is detached from the photosensitive member unit 6, the development unit 7 is held at a provisional support position at which a support target surface 700*c* of the housing 700 is supported by a holding portion 640B of each of the pressing members 640. The development unit 7 at the provisional support position is in a state where the rotation bearing member 746B (746A) of the development roller 71 is supported by the receiving portions 641. This state is referred to as the lift-up state. At this time, the lock (restriction of detachment of the development unit 7 from the photosensitive member unit 6) has been undone. When the user holds the holding portion 701 and immediately lifts up the development unit 7 in the lift-up state, the user can detach the development unit 7 from the photosensitive member unit 6 without involving movement of another member or the like. Thus, the user can detach the development unit 7 from the photosensitive member unit 6 and attach a new development unit 7 to the photosensitive member unit 6.

Cleaning Member for Scorotron Charger

Figure 10:
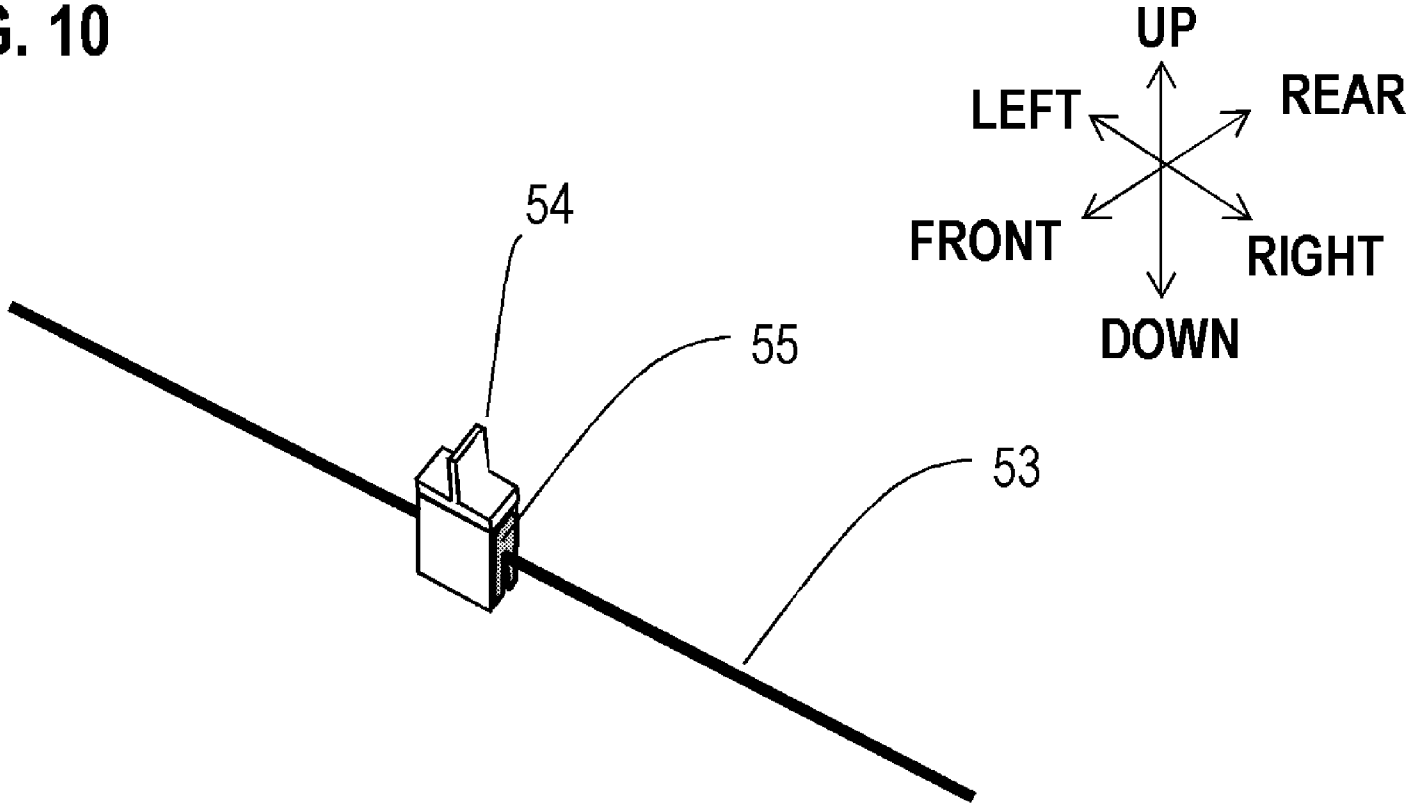
FIG. 10 is a perspective view of a charging wire and a cleaning member.

A description will be given of the cleaning member 54 for cleaning the charging wire 53 of the scorotron charger 52. As illustrated in FIG. 10, to clean the charging wire 53 extending in the left-right direction, the cleaning member 54 formed of sponge 55 or the like is provided in contact with the charging wire 53. The sponge 55 is configured to have a slit to allow the charging wire 53 to be held in the slit in sandwiched relation or configured such that the sponge in the form of a flat plate is folded back so as to hold the charging wire 53. As the cleaning member 54 moves along the longitudinal direction of the charging wire 53, the sponge 55 in which the charging wire 53 is held in sandwiched relation rubs off a deposit around the charging wire 53. A leftmost position of the cleaning member 54 in a movable range as illustrated in FIG. 20 is assumed to be a home position, and the cleaning member 54 is at this position when the cleaning member 54 does not execute a cleaning operation.

Figure 11:
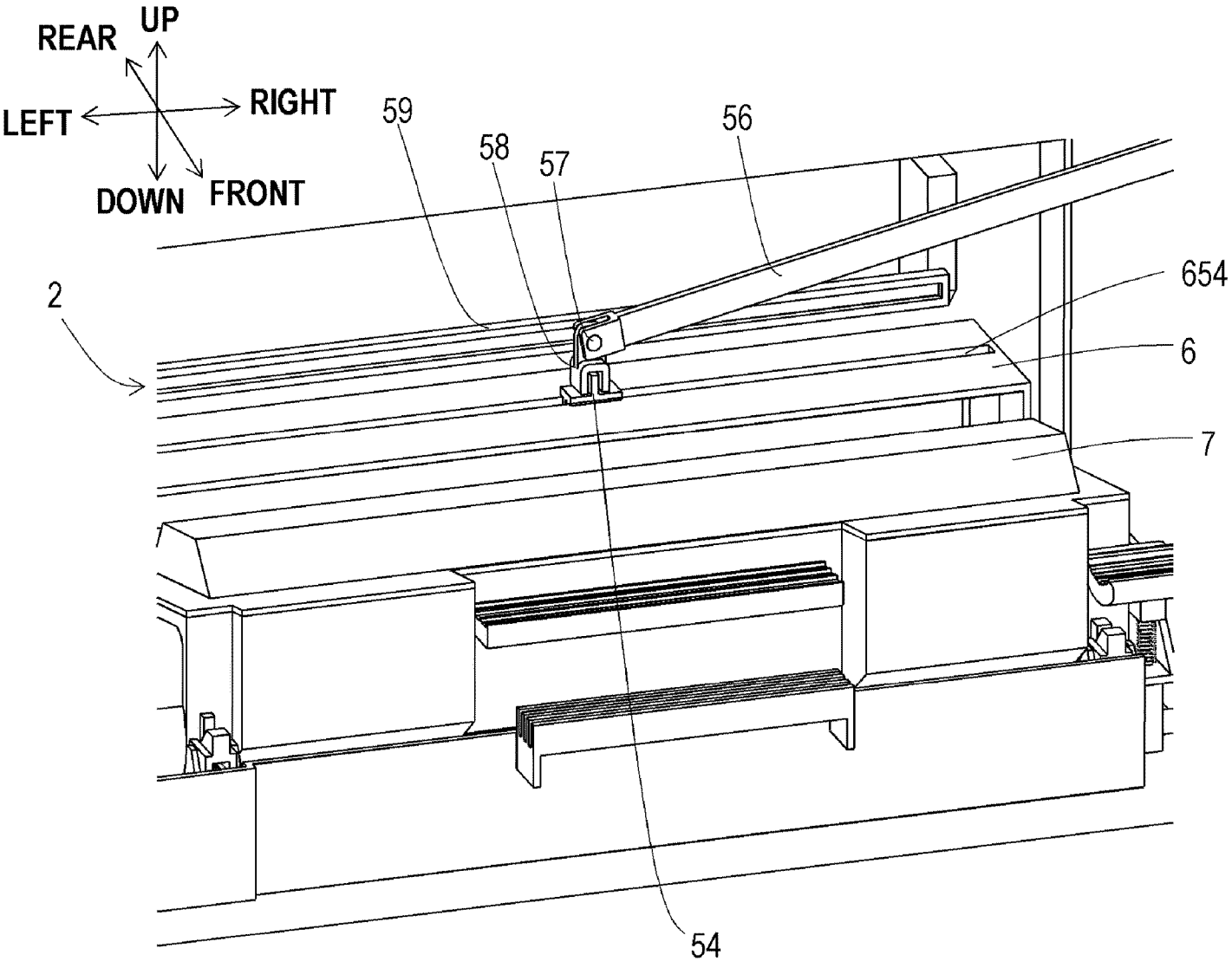
FIG. 11 is a perspective view of the cleaning member executing a cleaning operation.
Figure 12:
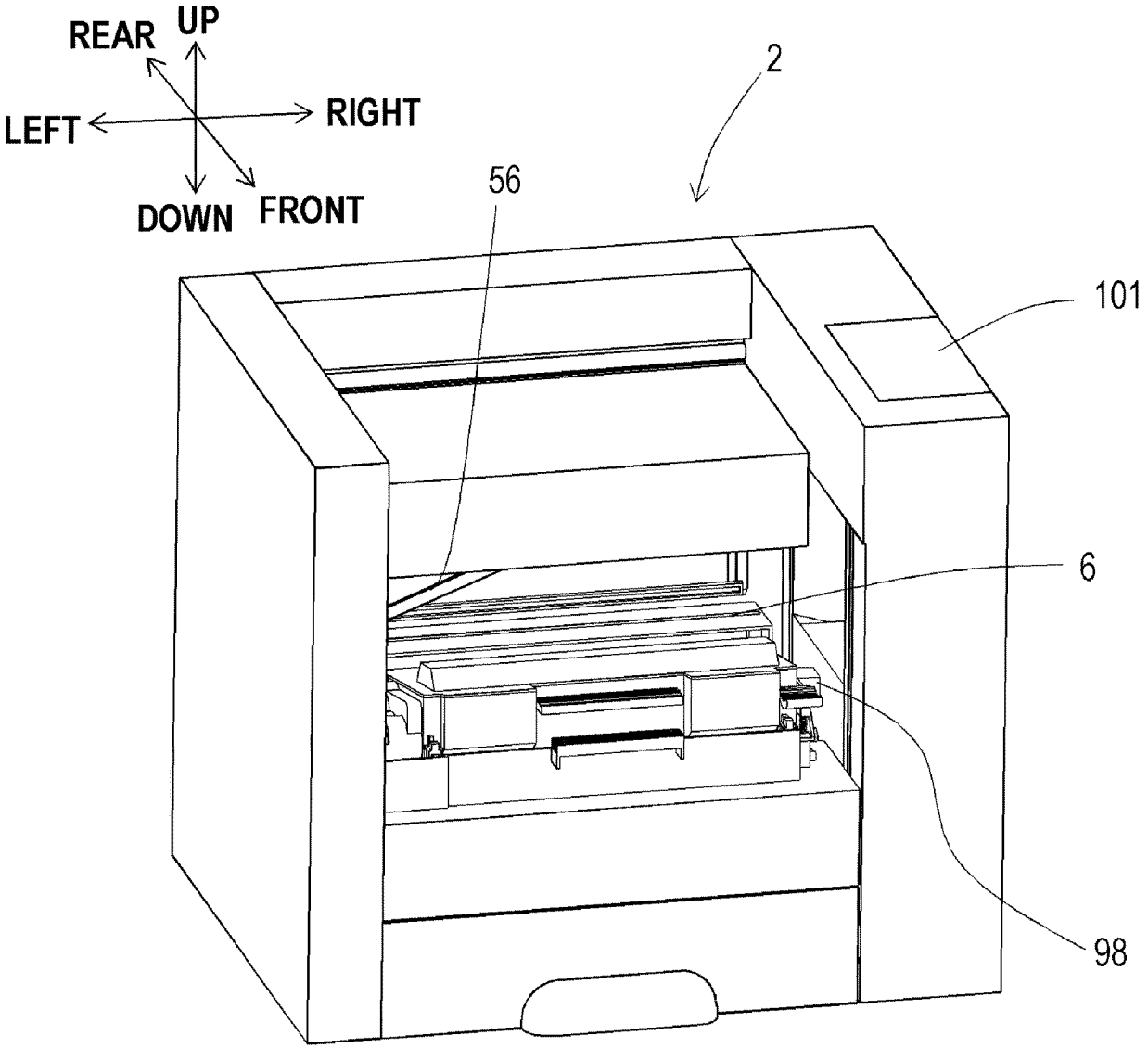
FIG. 12 is a view illustrating association between an operation of the cleaning member and a side surface cover opening/closing operation.
Figure 13:
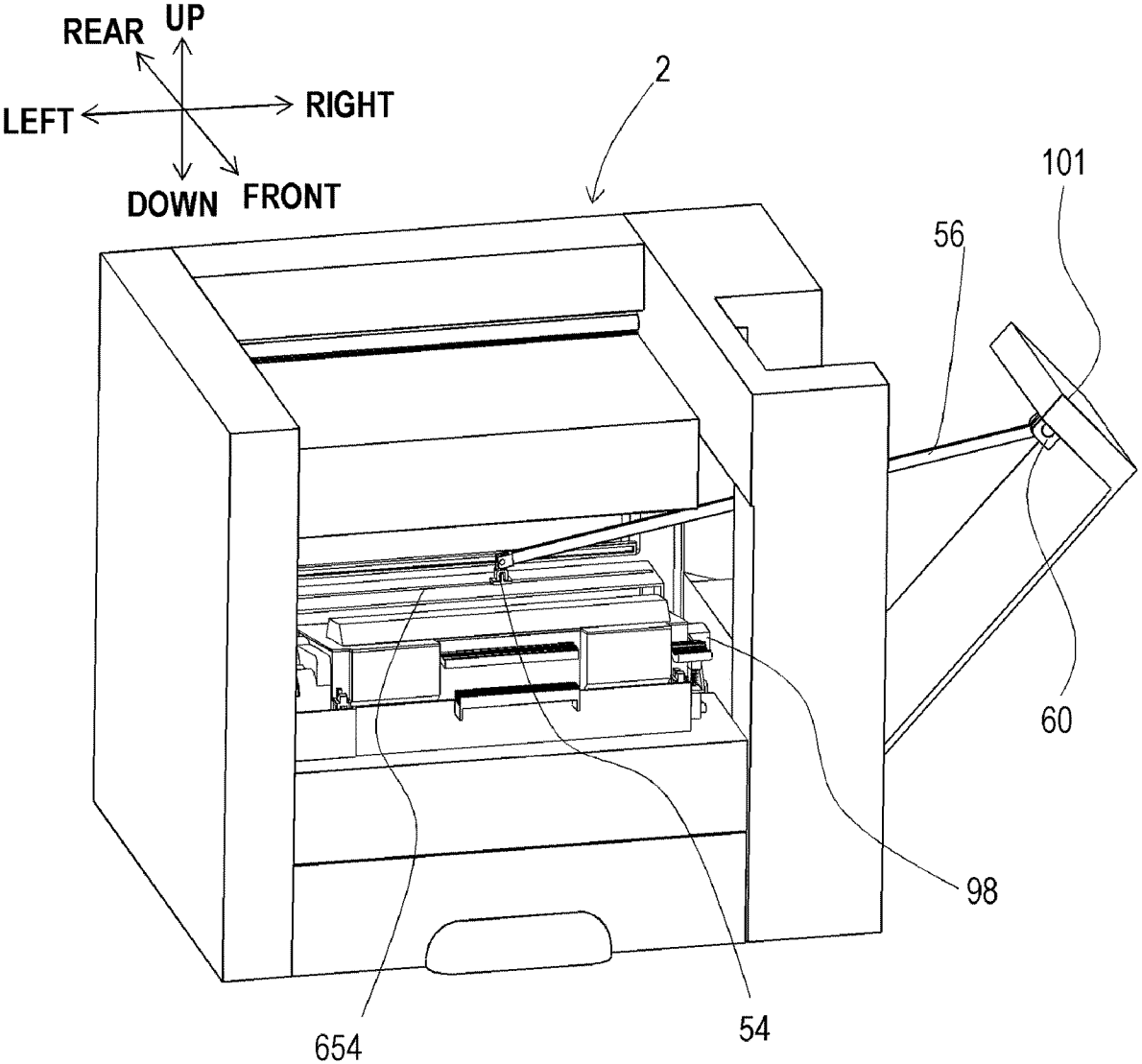
FIG. 13 is a view illustrating the association between the operation of the cleaning member and the side surface cover opening/closing operation.
Figure 14:
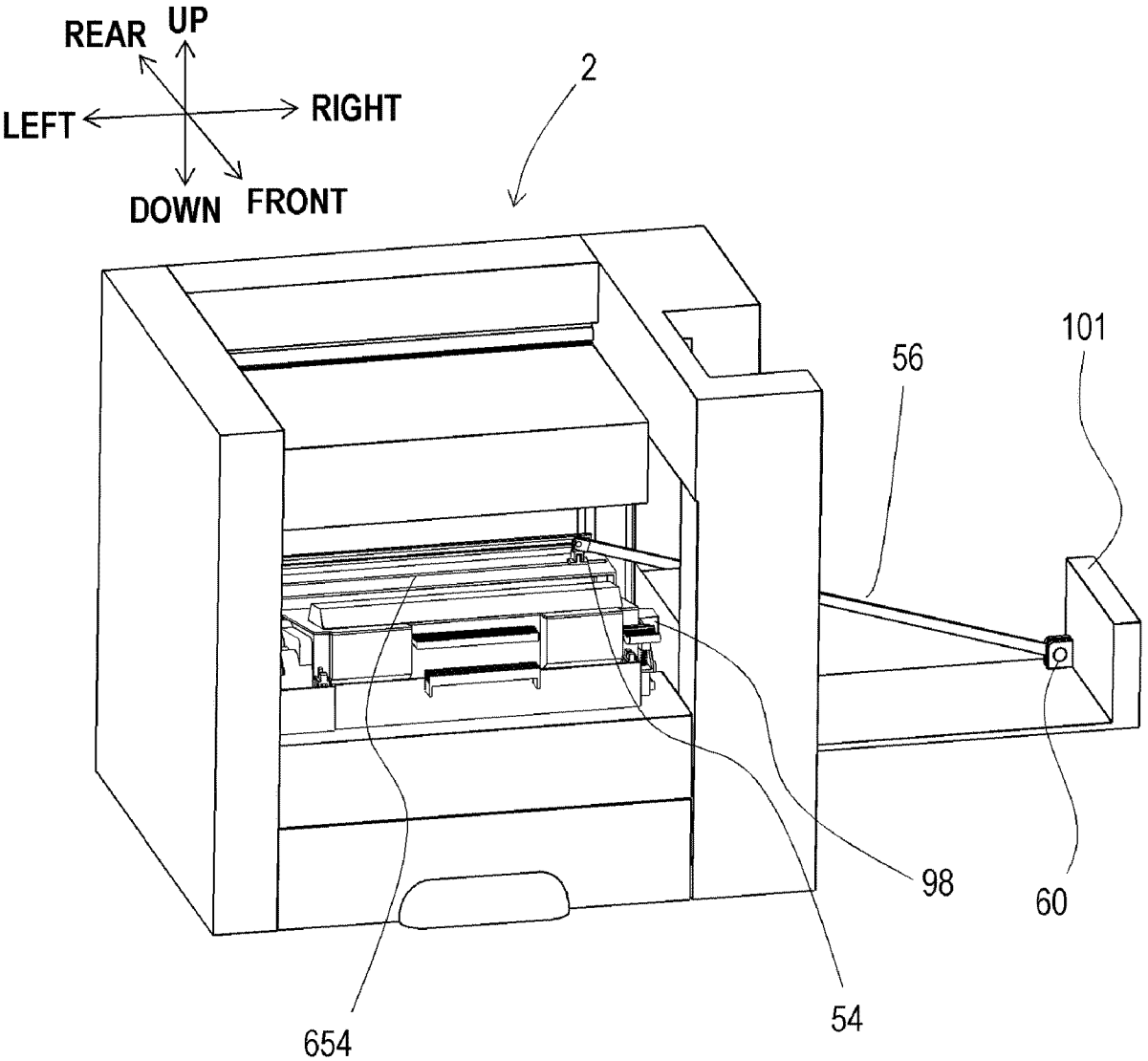
FIG. 14 is a view illustrating the association between the operation of the cleaning member and the side surface cover opening/closing operation.

Mechanism in Which Cleaning Member Moves in Association with Opening/Closing of Side Surface Cover A description will be given of a mechanism in which the cleaning member 54 moves in association with an opening/closing operation of a side surface cover 101 serving as the opening/closing member to execute a cleaning operation. As illustrated in FIG. 11, the apparatus main body 2 includes, as a driving mechanism of moving the cleaning member 54 relative to the charging wire 53, a first arm 56, an arm connection pin 57, a second arm 58, and a rail 59. A left end portion of the first arm 56 is connected (rotatively coupled) to the second arm 58 by using the arm connection pin 57. Meanwhile, a right end portion 60 of the first arm 56 is connected (rotatively coupled) to the side surface cover 101, as illustrated in FIGS. 12 to 14. A lower end portion of the second arm 58 has an inverted U shape to be able to be connected, as an engagement portion, to a projecting portion of an upper part of the cleaning member 54 as illustrated in FIG. 10. The arm connection pin 57 is connected also to the rail 59 to be movable along the rail 59 in parallel therewith in the left-right direction.

The cleaning member 54 assembled to the photosensitive member unit 6 of the process cartridge 5 and the driving mechanism provided in the apparatus main body 2 have respective engagement means to be drivingly connected to each other when the process cartridge 5 is attached to the apparatus main body 2. The engagement means can be configured to include, e.g., a projecting portion and a depressed portion which are provided in either one of the cleaning member 54 and the driving mechanism and in the other thereof and can be engaged with each other. In the first embodiment, the projecting portion is provided in the cleaning member 54 and the depressed portion having the inverted U shape is provided in a lower end portion of the second arm 58 of the driving mechanism. However, the projecting portion and the depressed portion may also be configured in a reverse combination. The depressed portion is configured to have a groove shape extending in an attachment/detachment direction when the cartridge 5 is attached to the apparatus main body 2 and having open both ends in the attachment/detachment direction so as to allow the projecting portion to fit in (enter) the depressed portion when the cartridge 5 moves to be attached/detached to/from the apparatus main body 2. The depressed portion and the projecting portion are configured to be able to come into contact with each other in a direction perpendicular to the attachment/detachment direction. The cleaning member 54 is assembled to a frame body of the photosensitive member unit 6 to be movable along a guide slit 654 provided in the frame body of the photosensitive member unit 6, and the guide slit 654 extends in a direction perpendicular to the attachment/detachment direction. This direction coincides with a direction of movement in which the second arm 58 is guided by the rail 59 in the apparatus main body 2. Accordingly, in a state where the cartridge 5 is attached to the apparatus main body 2, the contact (engagement) between the depressed portion and the projecting portion described above in a direction perpendicular to the attachment/detachment direction described above allows the driving force of the driving mechanism of the apparatus main body 2 to be transmitted to the cleaning member 54. In other words, in response to an operation of the second arm 58, the cleaning member 54 moves along a direction in which the guide slit 654 extends.

As a result, when the side surface cover 101 is closed and the photosensitive member unit 6 is attached to the apparatus main body in a state where the cleaning member 54 is at the home position, the upper projecting portion of the cleaning member 54 and the inverted-U-shaped portion of the second arm 58 are brought into a connected state. Accordingly, as illustrated in FIGS. 12 to 14, the first arm 56 moves in response to an opening/closing operation of the side surface cover 101, and the second arm moves along the rail 59 in parallel therewith in the left-right direction, and consequently the cleaning member 54 also moves in the left-right direction in association therewith to be able to clean the charging wire 53.

Toner Feeding Unit and Connection Cylinder

As illustrated in FIG. 6, the image forming apparatus 1 includes the toner feeding unit 94 and the connection cylinder 98.

Figure 7:
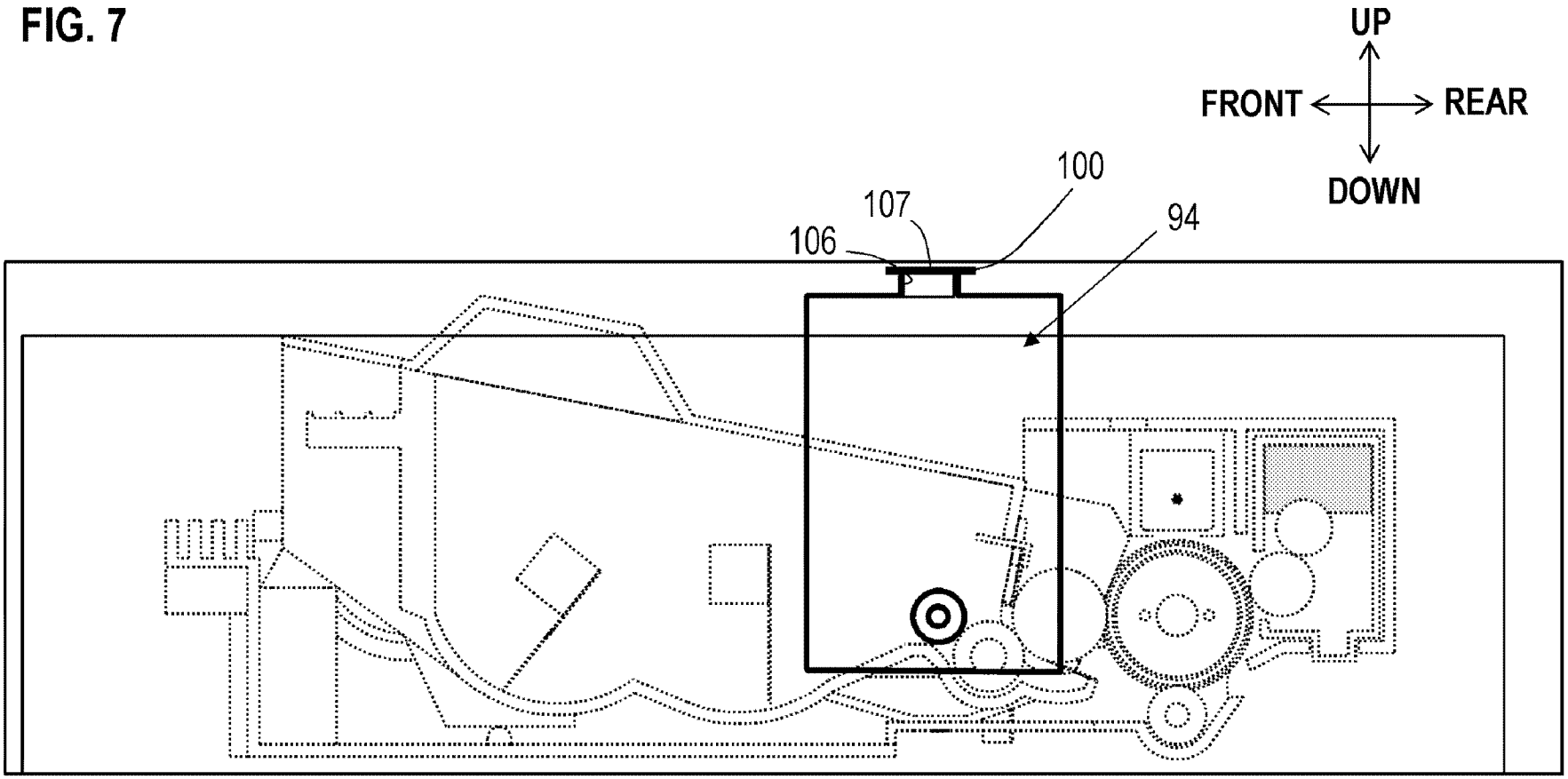
FIG. 7 is a cross-sectional view of a toner feeding unit.

The toner feeding unit 94 is disposed on a right side of the connection cylinder 98. The toner feeding unit 94 has a generally box-like shape. The toner feeding unit 94 includes a projecting portion 100 (FIG. 7).

The projecting portion 100 is located on an upper end portion of the toner feeding unit 94. The projecting portion 100 upwardly projects from a center portion of an upper wall of the toner feeding unit 94.

The side surface cover 101 is located to extend from an upper part of the toner feeding unit 94 to a right side surface thereof, and has an inverted L shape as illustrated in FIG. 13. An upper end portion of the side surface cover 101 is located above the projecting portion 100. The side surface cover 101 can be opened/closed in a rightward direction around a lower position on a right side surface of the image forming apparatus. In response to the opening/closing operation of the side surface cover 101, the cleaning member 54 for the charging wire 53 described later can be moved.

As illustrated in FIG. 6, the connection cylinder 98 is disposed to extend in the left-right direction and have a right end portion connected to a left end portion of the toner feeding unit 94, while having a left end portion connected to a right end portion of the toner containing portion 74 of the development unit 7. The connection cylinder 98 cannot be detached from the apparatus main body 2. As illustrated in FIG. 6, the connection cylinder 98 has an inlet port 104 and an outlet port 105.

As illustrated in FIG. 6, the inlet port 104 is located at the right end portion of the connection cylinder 98. The inlet port 104 extends through the right end portion of the connection cylinder 98 in the left-right direction.

As illustrated in FIG. 6, the outlet port 105 is located at the left end portion of the connection cylinder 98. The outlet port 105 extends through the left end portion of the connection cylinder 98 in the left-right direction. The outlet port 105 communicates with the right end portion of the toner containing portion 74 via the sealing member 99.

A screw 103 is located in the connection cylinder 98 and in the toner feeding unit 94. The screw 103 is an auger screw extending in the left-right direction. A left end portion of the screw 103 is rotatively supported by a left wall of the connection cylinder 98. A right end portion of the screw 103 extends through a right wall of the toner feeding unit 94 to be connected to a motor not shown.

As illustrated in FIG. 7, the toner feeding unit 94 includes a receiving hole 106 and a lid 107. The receiving hole 106 is located in an upper end portion of the toner feeding unit 94 and has a substantially cylindrical shape. The lid 107 is detachably attached to the receiving hole 106.

Resupply of Toner to Toner Feeding Unit

A description will be given of a resupply of the toner to the toner feeding unit 94.

Figure 8:
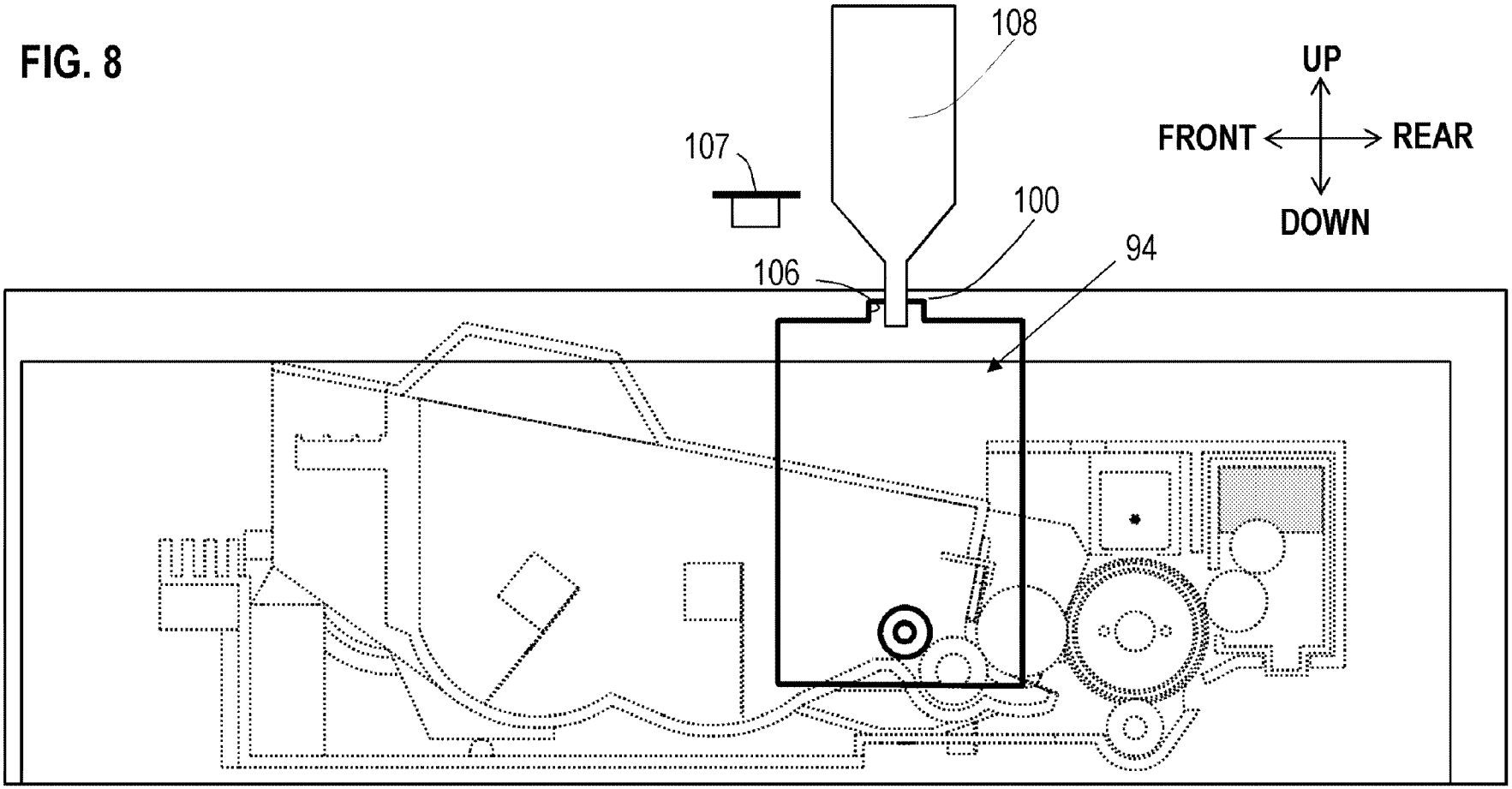
FIG. 8 is a diagram illustrating a resupply of a toner to the toner feeding unit.

The user opens the side surface cover 101 in the rightward direction, as illustrated in FIG. 14. Then, the user detaches the lid 107 from the receiving hole 106 of the toner feeding unit 94, as illustrated in FIG. 8. Then, the user inserts a toner resupplier 108 into the receiving hole 106 to resupply the toner to the toner feeding unit 94. When the resupply of the toner is completed, the user attaches the lid 107 to the receiving hole 106 of the toner feeding unit 94. Then, the user closes the side surface cover 101 to thus return the side surface cover 101 to an original position. By this operation, the cleaning member 54 is moved as described above to clean the charging wire 53.

Effect of Invention in First Embodiment

By using a configuration as used in the first embodiment, the opening/closing operation of the side surface cover 101 when the toner is resupplied to the toner feeding unit 94 allows the cleaning operation to be executed on the charging wire 53. Consequently, it is possible to reduce the cleaning operation manually executed thus far by the user on the charging wire 53 by taking out the photosensitive member unit 6 from the apparatus main body and also prevent formation of a defective image due to deposition of the foreign material on the charging wire 53. In addition, since the charging wire 53 is automatically cleaned with the timing of resupplying the toner, the cleaning is periodically executed, and therefore it is possible to reduce a workload placed on the user in the cleaning of the charging wire. Moreover, it becomes easier to maintain an excellent state against the deposition of the foreign material on the charging wire 53.

Modification of First Embodiment

In the first embodiment, the photosensitive member unit 6 is detachable from the apparatus main body 2, but the configuration is not limited thereto.

For example, even when the photosensitive member unit 6 cannot be detached from the apparatus main body 2, it is possible to move the cleaning member 54 in association with the opening/closing operation of the side surface cover 101 in the same manner as in the first embodiment.

Alternatively, even when the configuration is such that the scorotron charger 52 is a member separate from the photosensitive member unit 6 and cannot be taken out of the apparatus main body 2, it is possible to move the cleaning member 54 for the charging wire 53 in association with the opening/closing operation of the side surface cover 101 in the same manner as in the first embodiment.

It may also be possible to move the cleaning member 54 in association with not the side surface cover 101, but another opening/closing member of the apparatus main body, such as the front door 21.

In addition, the configuration is not limited to a configuration in which the cleaning member 54 is moved in association with a constituent member assembled to an apparatus frame body to expose the inner portion of the apparatus, such as the side surface cover 101. In other words, the configuration described in the first embodiment is such that the side surface cover 101 has both the function of opening the inner portion of the apparatus to the outside of the apparatus and the function of a to-be-operated portion for controlling the cleaning operation of the cleaning member 54. Unlike this, the configuration may also be such that the to-be-operated portion exposed to the outside of the apparatus is disposed as the to-be-operated portion dedicated to the control of the cleaning operation of the cleaning member 54, and a driving mechanism which allows movement of the cleaning member 54 relative to the charging wire 53 through the operation of the to-be-operated portion by the user is provided. Since the user can clean the charging wire 53 by merely operating the to-be-operated portion, there is no more need for such opening/closing of the cover as performed previously, and it is possible to reduce the workload.

Note that, in the first embodiment, the configuration is such that the cleaning member 54 is moved relative to the fixed charging wire 53, but the configuration may also be such that the charging wire 53 is moved relative to the fixed cleaning member 54. Alternatively, the configuration may also be such that both the cleaning member 54 and the charging wire 53 are moved relative to each other.

Also, in the first embodiment, the description has been given of the cleaning operation in the single process cartridge 5 but, in a multi-color image forming apparatus in which a plurality of process cartridges are arranged also, it is similarly possible to allow the cleaning operation to be executed in association with the opening/closing operation of the side surface cover.

Second Embodiment

A second embodiment uses a configuration in which a detecting member 110 detects the opening/closing of the side surface cover 101, and a cleaning motor 111 attached to the apparatus main body 2 subsequently drives a belt 112 to allow the cleaning member 54 to move along the charging wire 53 and clean the charging wire 53. In such a configuration also, there is no more need for the user to directly clean the charging wire, and therefore it is possible to reduce labor of the user. Since other components in the second embodiment are the same as the components in the first embodiment, a description thereof is omitted.

Cleaning Member Movement Mechanism in Second Embodiment

Figure 25:
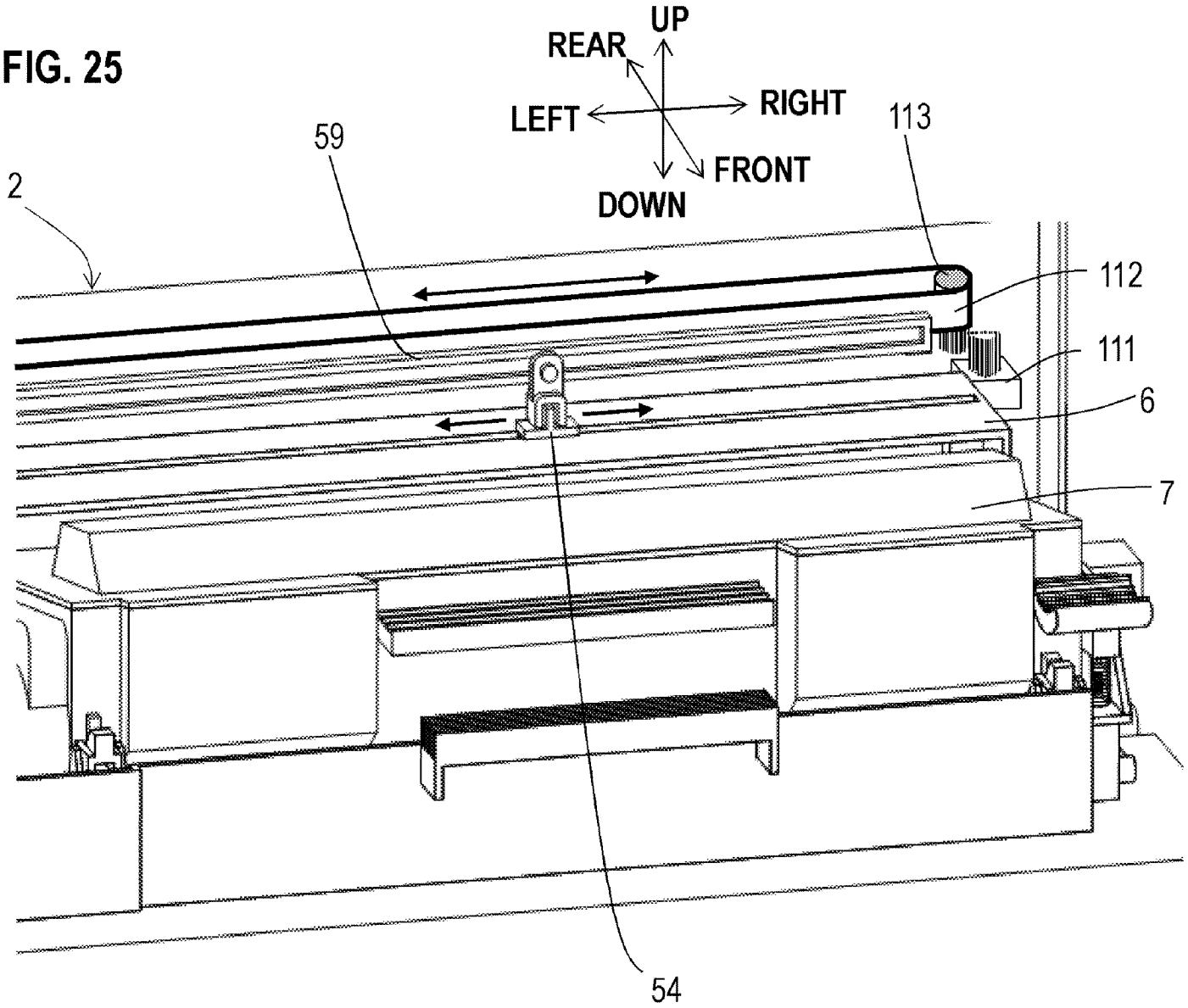
FIG. 25 is a view illustrating an operation of a cleaning member in a second embodiment.

Referring to FIG. 25, a description will be given of a mechanism of moving the cleaning member 54 in the second embodiment. In the second embodiment, unlike in the first embodiment, the first arm 56 is not provided and instead, as illustrated in FIG. 25, the cleaning motor 111 serving as a power source, the belt 112 serving as a transmission means for transmitting a driving force of the motor, a drive roller 113, and a facing roller (not shown) are additionally provided. The annular belt 112 is wound in tension around the drive roller 113 and the facing roller (not shown) to be fixed, and is movable in the left-right direction with rotation of the drive roller 113.

The cleaning member 54 is connected to the belt 112 and moves with movement of the belt 112 to be able to execute an operation of cleaning the charging wire 53.

Block Diagram

Figure 26:
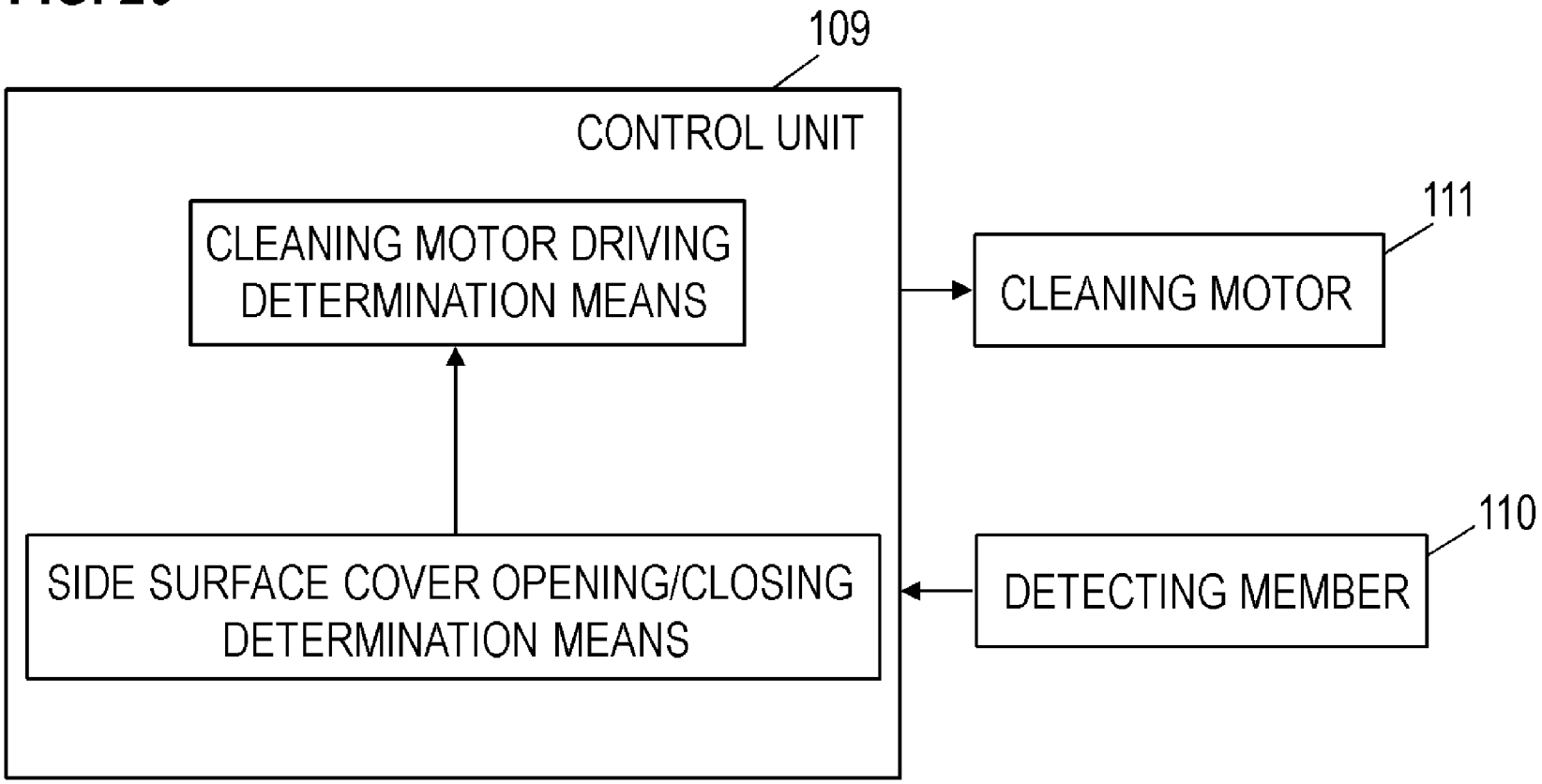
FIG. 26 is a control block diagram in the second embodiment.

Next, referring to a control block diagram of FIG. 26, a description will be given of a control configuration in the second embodiment. A control unit 109 includes a CPU (central processing unit) that performs arithmetic processing, a memory serving as a storage means, and I/F that inputs/outputs information to/from a peripheral device, and the like. The control unit 109 is a control means for generally controlling an operation of the image forming apparatus 1 and connected to each of control targets in the image forming apparatus 1 via the input/output I/F. As illustrated in FIG. 26, based on information from the detecting member 110, the control unit 109 determines whether the side surface cover 101 is open or closed and controls driving of the cleaning motor 111. As the detecting member 110 that detects the opening or closing of the side surface cover 101, conventionally known detecting means of a contact type, an optical type, or the like can appropriately be used.

Execution Process of Cleaning Operation

Figure 27:
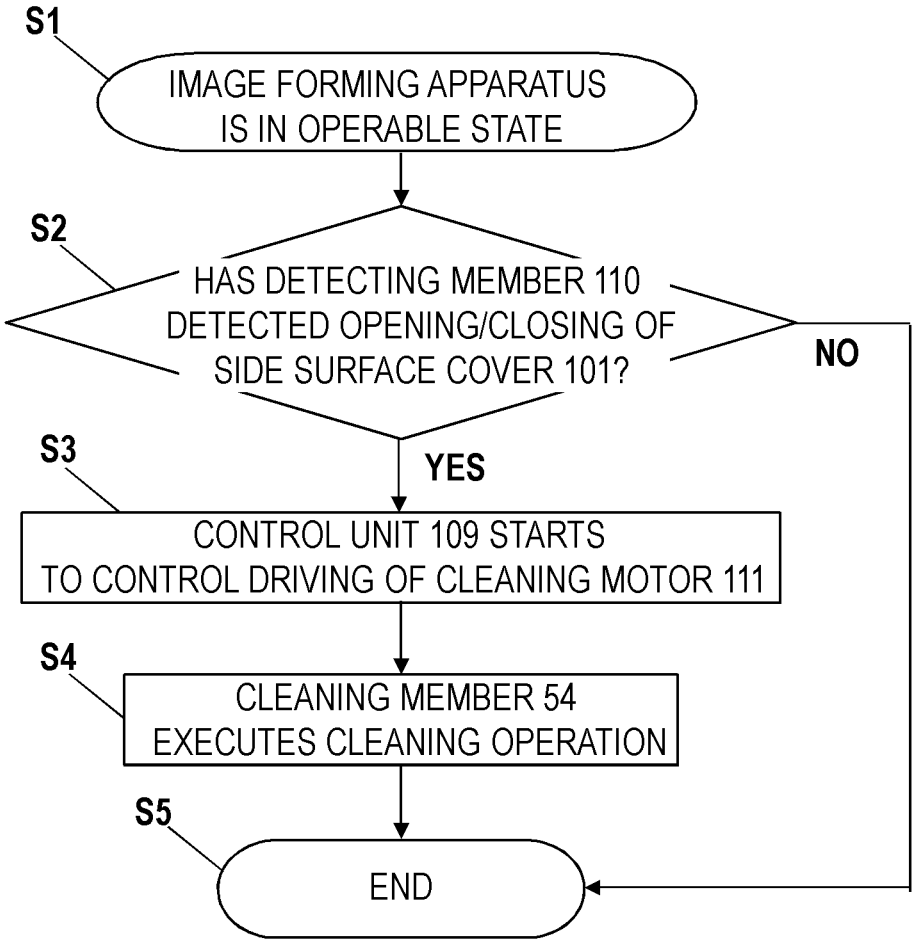
FIG. 27 is a flow chart before a cleaning operation is executed in the second embodiment.

Next, a process before a toner feeding step is performed in the second embodiment will be described with reference to a flow chart of FIG. 27. When the image forming apparatus 1 is brought into an operable state, the flow chart illustrated in FIG. 27 is started (S1).

When the detecting member 110 detects opening/closing of the side surface cover 101 (YES in S2), the control unit 109 starts to control the driving of the cleaning motor 111 (S3). The cleaning member 54 is caused to reciprocate once in the left-right direction to execute the cleaning operation (S4), which is then ended (S5).

In S2, when the opening/closing of the side surface cover 101 is not detected, the process is immediately ended (S5).

As has been described above, even a configuration as used in the second embodiment allows the opening/closing operation of the side surface cover 101 when the toner is resupplied to the toner feeding unit 94 to implement the operation of cleaning the charging wire 53, in the same manner as in the first embodiment. Therefore, it is possible to reduce the operation of cleaning the charging wire 53 manually executed thus far by the user by taking out the photosensitive member unit 6 from the apparatus main body and also prevent formation of a defective image due to the deposition of a foreign material on the charging wire 53. In addition, since the charging wire 53 is automatically cleaned with the timing of resupplying the toner, cleaning is periodically executed, and it is easier to maintain an excellent state against the deposition of the foreign material on the charging wire 53.

According to the present invention, it is possible to reduce a workload placed on the user in cleaning of the charging member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-102715, filed on Jun. 12, 2020, which is hereby incorporated by reference herein in its entirety.

What is claimed is:

1. An image forming apparatus comprising:

a photosensitive member;

a charging member for charging the photosensitive member;

a cleaning member that comes into contact with the charging member and moves relative to the charging member to clean the charging member; and an opening/closing member for exposing an inside of the apparatus, the image forming apparatus further comprising a driver that moves the cleaning member relative to the charging member that is fixed, in association with opening/closing of the opening/closing member.

2. The image forming apparatus according to claim 1, further comprising a containing portion for a developer, wherein the opening/closing member is opened/closed when the developer is replenished to the containing portion.

3. The image forming apparatus according to claim 1, wherein the charging member includes a wire, and wherein the cleaning member includes a sponge for holding the wire in a sandwiched manner and moves along a longitudinal direction of the wire.

4. The image forming apparatus according to claim 1, wherein the driver includes an arm connecting the opening/closing member and the cleaning member, and a rail for guiding movement of the arm.

5. The image forming apparatus according to claim 1, wherein the driver includes a motor and a driving force transmission for transmitting a driving force of the motor to the cleaning member.

6. The image forming apparatus according to claim 5, wherein the driving force transmission includes an annular belt and a roller that rotates the belt wound with tension therearound, and the belt is engaged with the cleaning member.

7. The image forming apparatus according to claim 5, further comprising a detector for detecting the opening/closing of the opening/closing member, wherein the driver moves the cleaning member relative to the charging member that is fixed, when the detector detects the opening/closing of the opening/closing member.

8. The image forming apparatus according to claim 1, further comprising a cartridge including the photosensitive member, the charging member, and the cleaning member and detachable from an apparatus main body of the image forming apparatus, wherein the opening/closing member and the driver are provided in the apparatus main body, and wherein the cleaning member and the driver include respective engagement members that are drivingly connected to each other when the cartridge is attached to the apparatus main body.

9. The image forming apparatus according to claim 8, wherein the cleaning member is provided to be movable in a direction perpendicular to an attachment/detachment direction in which the cartridge is attached/detached to/from the apparatus main body, and wherein the engagement members include a projecting portion provided in one of the cleaning member and the driver and a depressed portion provided in the other of the cleaning member and the driver and, when the cartridge is attached to the apparatus main body, the projecting portion and the depressed portion are engaged with each other in the attachment/detachment direction and are driven by the driver to come into contact with each other in the direction perpendicular to the attachment/detachment direction, thereby transmitting a driving force of the driver to the cleaning member.

10. The image forming apparatus according to claim 9, wherein the charging member is fixed to a frame body of the cartridge, and wherein the cleaning member is assembled to the frame body to be movable along a guide slit provided in the frame body.

11. The image forming apparatus according to claim 10, wherein the guide slit is provided in the frame body so as to extend in the direction perpendicular to the attachment/detachment direction.

12. An image forming apparatus comprising:

a photosensitive member;

a charging member for charging the photosensitive member; and a cleaning member that comes into contact with the charging member and moves relative to the charging member to clean the charging member, the image forming apparatus further comprising a driver that has an operating member exposed to an outside of the apparatus and moves the cleaning member relative to the charging member that is fixed, through operation of the operating member.

13. The image forming apparatus according to claim 12, wherein the operating member is an opening/closing member for exposing an inside of the apparatus, and wherein the driver moves the cleaning member relative to the charging member that is fixed, in association with opening/closing of the opening/closing member.

14. A cartridge detachable from an apparatus main body of an image forming apparatus, the cartridge comprising:

a frame body;

a photosensitive member;

a charging member for charging the photosensitive member; and a cleaning member that comes into contact with the charging member and moves relative to the charging member to clean the charging member, wherein the cleaning member has an engagement portion that projects to an outside of the frame body and that engages with a driver provided in the apparatus main body, and the engagement portion receives a driving force from the driver that drives the cleaning member in association with opening/closing of an opening/closing member of the apparatus main body to move relative to the charging member, and wherein the driver moves the cleaning member relative to the charging member that is fixed.

15. The cartridge according to claim 14, wherein the charging member is fixed to the frame body, and wherein the cleaning member is assembled to the frame body to be movable along a guide slit provided in the frame body.

16. The cartridge according to claim 15, wherein the guide slit is provided in the frame body so as to extend in a direction perpendicular to an attachment/detachment direction in which the cartridge is attached/detached to/from the apparatus main body of the cartridge.

* * * * *